US009753387B2

(12) United States Patent
Hasegawa et al.

(10) Patent No.: US 9,753,387 B2
(45) Date of Patent: Sep. 5, 2017

(54) TONER, DEVELOPER AND DEVELOPER CONTAINING UNIT

(71) Applicants: Shin Hasegawa, Tokyo (JP); Tsuyoshi Sugimoto, Shizuoka (JP); Hideyuki Santo, Kanagawa (JP); Koh Ohnuma, Shizuoka (JP); Kohsuke Nagata, Shizuoka (JP); Suzuka Karato, Shizuoka (JP)

(72) Inventors: Shin Hasegawa, Tokyo (JP); Tsuyoshi Sugimoto, Shizuoka (JP); Hideyuki Santo, Kanagawa (JP); Koh Ohnuma, Shizuoka (JP); Kohsuke Nagata, Shizuoka (JP); Suzuka Karato, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/152,963

(22) Filed: May 12, 2016

(65) Prior Publication Data

US 2016/0349644 A1 Dec. 1, 2016

(30) Foreign Application Priority Data

May 27, 2015 (JP) ..... 2015-107739

(51) Int. Cl.

| | |
|---|---|
| ***G03G 9/08*** | (2006.01) |
| ***G03G 9/087*** | (2006.01) |
| ***G03G 15/01*** | (2006.01) |

(52) U.S. Cl.

CPC ..... *G03G 9/08755* (2013.01); *G03G 9/0804* (2013.01); *G03G 9/0825* (2013.01); *G03G 15/0126* (2013.01)

(58) Field of Classification Search

CPC ..... G03G 9/0877; G03G 9/0825
USPC ..... 430/109.4, 111.4
See application file for complete search history.

(56) References Cited

U.S. PATENT DOCUMENTS

| | | | | |
|---|---|---|---|---|
| 2003/0165760 | A1* | 9/2003 | Higuchi | G03G 9/08755 430/108.4 |
| 2004/0115551 | A1 | 6/2004 | Sugiyama et al. | |
| 2011/0177447 | A1 | 7/2011 | Suzuki et al. | |
| 2013/0059247 | A1 | 3/2013 | Sugimoto et al. | |
| 2015/0037718 | A1 | 2/2015 | Morita et al. | |

FOREIGN PATENT DOCUMENTS

| | | |
|---|---|---|
| JP | 2004-046095 | 2/2004 |
| JP | 2004-126160 | 4/2004 |
| JP | 2007-271789 | 10/2007 |
| JP | 2011-203704 | 10/2011 |
| JP | 2013-054178 | 3/2013 |
| JP | 2014-059489 | 4/2014 |

* cited by examiner

*Primary Examiner* — Mark A Chapman
(74) *Attorney, Agent, or Firm* — Oblon, McClelland, Maier & Neustadt, L.L.P.

(57) ABSTRACT

A toner includes a base particle including a polyester resin and a colorant. A sea-island structure is observed by a transmission electron microscope (TEM) in a cross-sectional image of the toner. The island structure includes the colorant and has an average diameter of from 0.2 μm to 1.0 μm, and the number of the island structure is from 5 to 30.

10 Claims, 7 Drawing Sheets

TONER, DEVELOPER AND DEVELOPER CONTAINING UNIT

CROSS-REFERENCE TO RELATED APPLICATIONS

This patent application is based on and claims priority pursuant to 35 U.S.C. §119 to Japanese Patent Application No. 2015-107739, filed on May 27, 2015, in the Japan Patent Office, the entire disclosure of which is hereby incorporated by reference herein.

BACKGROUND

Technical Field

The present invention relates to a toner, a developer including the toner and a developer containing unit containing the developer.

Description of the Related Art

A toner having good low-temperature fixability and heat resistant preservability, and producing quality images has been required recently.

SUMMARY

A toner includes a base particle including a polyester resin and a colorant. A sea-island structure is observed by a transmission electron microscope (TEM) in a cross-sectional image of the toner. The island structure includes the colorant and has an average diameter of from 0.2 μm to 1.0 μm, and the number of the island structure is from 5 to 30.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
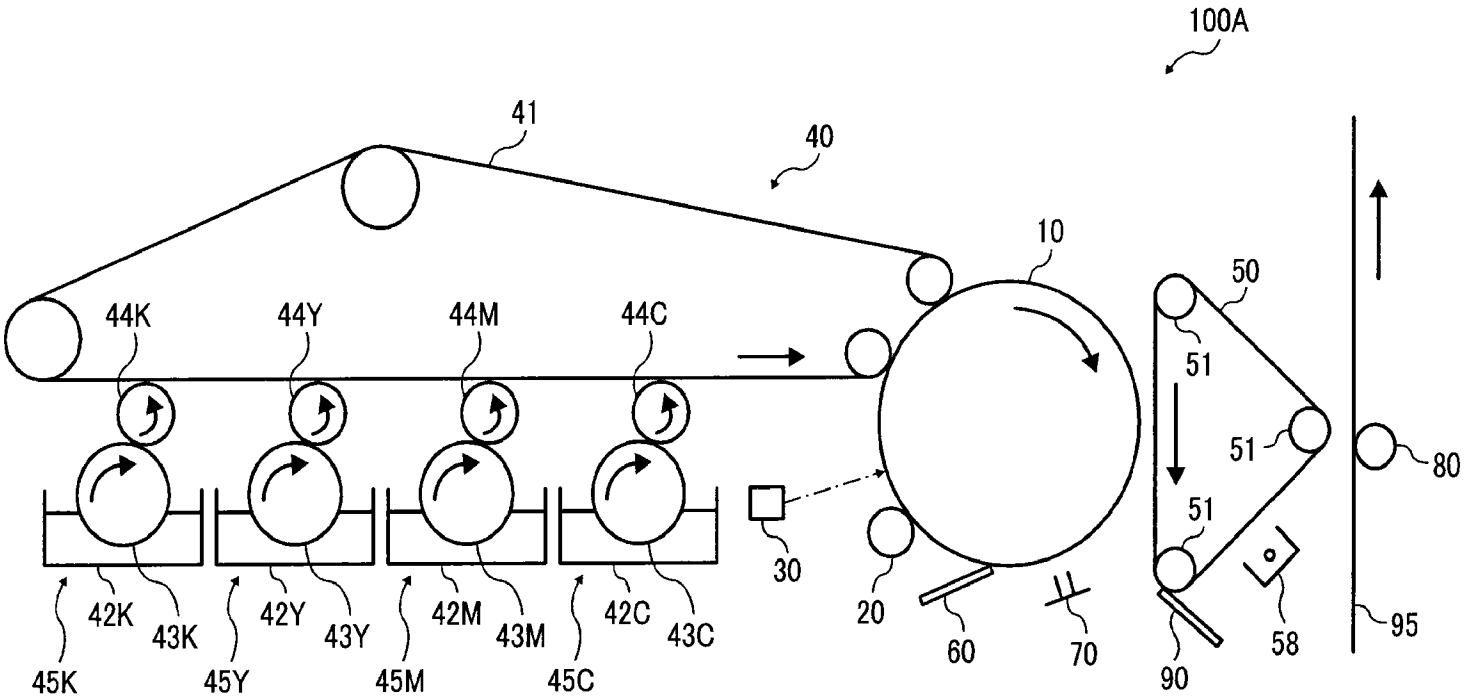
FIG. 1 is a schematic view illustrating an embodiment of the image forming apparatus of the present invention.

There is a need for providing a toner having good low-temperature fixability and heat resistant preservability, and producing quality images, and a developer including the toner and a developer containing unit containing the developer.

More particularly, the present invention relates to a toner including a base particle including a polyester resin; and a colorant, wherein a sea-island structure is observed by a transmission electron microscope (TEM) in a cross-sectional image of the toner, and wherein the island structure comprises the colorant and has an average diameter of from 0.2 μm to 1.0 μm, and the number of the island structure is from 5 to 30.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

[Toner]

The toner of the present invention includes a base particle including at least a polyester resin and a colorant. When a cross-sectional of the toner is observed by a transmission electron microscope (TEM), a sea-island structure satisfying the above requirements is formed. The toner of the present invention may include other components such as a release agent, a charge controlling agent, an external additive, a cleanability improver and magnetic materials when necessary besides the polyester resin and the colorant.

<Observation of Transmission Microscope (TEM)>

After the toner is buried in an epoxy resin, a slice of the toner is formed by an ultramicrotome (ultrasonic), and a cross-section of the toner is observed by a transmission electron microscope. The amplification of the microscope is adjusted and a contrast is adjusted such that a sea-island structure can be identified from the cross-section of the toner. A sight of the microscope is amplified until the island structure is observable and random 50 points of the toner are abstracted. After abstracted, an average of diameters of the islands can be determined from the image files using, e.g., an image analysis software Image J. When a distance between the particles is not less than 1/50 of the average particle diameter, each of the particles is defined as one island.

When the island has a diameter not less than 1.0 μm, a resin in the base particle of a toner is difficult to mix, resulting in lower glossiness after fixed. When the island has a diameter not greater than 0.2 μm, the pigment (colorant) and the resin are not uniformly mixed, the pigment tends to unevenly be distributed, resulting in poor low-temperature fixability.

The number of the islands is preferably from 5 to 30, and more preferably from 10 to 20. When less than 5, a resin in the base particle of a toner is difficult to mix, resulting in lower glossiness after fixed. When greater than 30, a pigment which is not included in the island structure begins to be present in the toner and unevenly distributed at the surface thereof.

The toner preferably includes the colorant in an amount not greater than 50% in an area from the surface thereof to the center thereof at a depth not greater than 1,000 nm. However, when not greater than 5%, the uneven distribution is improved, but pigments aggregate with each other at the center, resulting in lower glossiness after fixed.

The uneven distribution of the colorant can be seen as follows.

Namely, an ultrathin chip of a toner is observed by a transmission electron microscope (TEM) at 100,000 times to obtain an image. The image is digitalized by an image processor to determine an area S1 occupied with a pigment within 1,000 nm from the surface and an area S2 occupied therewith out of out of 1,000 nm therefrom. In the present invention, S1/(S1+S2) is not greater than 0.5.

Images of randomly selected 10 toner base particles having a maximum volume average diameter ±10% are averaged.

<Resin for Dispersing Colorant>

Formation of the sea-island structure and the island structure including the colorant can be controlled by phase separability with a resin for dispersing colorant and other polyester resins, conditions of preparing a masterbacth with a colorant and the resin for dispersing colorant, toner formulation, emulsification conditions, etc.

When the resin for dispersing colorant has the following transmittances after dissolved in ethylacetate, the resin for dispersing colorant hardly soluble in ethylacetate and other polyester resins suitably cause phase separation.

(a) When the solution having a concentration of 20% by mass of the resin for dispersing colorant has a transmittance T (60)% for light of 500 nm at an optical path length of 1 cm 60 min later and a transmittance T (480)% 480 min later, T (60)%−T (480)%≥30% and T (480)% is not greater than 50%.

(b) Preferably in addition to (a), T (60)% is not less than 30%.

When the resin for dispersing colorant has higher solubility, the resin is compatible with the other polyester resins. A sea-island structure is not formed and a pigment is unevenly distributed at the surface, resulting in poor low-temperature fixability. When the resin for dispersing colorant has higher insolubility, the resin and the other polyester resins form fewer island structures having larger diameters, resulting in lower glossiness.

The lower the transmittance T (%), the lower the solubility. In the present invention, T (60)%−T (480)% is large and T (60)% is suitably large to have suitable compatibility with the other polyester resins. The sea-island structure differs in methods of preparing masterbatch due to dispersibility of a pigment and a resin for dispersing colorant. The masterbatch tends to have no sea-island structure or fewer island structures having larger diameters. Kneading is strengthened or kneading and cooling are repeated for a few times to improve dispersibility.

When the island structure has an average diameter of from 0.2 μm to 1.0 μm and the number of the island structure is from 5 to 30, a polyester resin the tetrahydrofuran (THF)-insolubles of which is a trivalent aliphatic isocyanate is used to obtain glossiness, image density, heat resistant preservability and low-temperature fixability which have not been expected so far. Such a polyester resin preferably has one of the following formulae (1) to (3).

$$R1\text{-}(NHCONH—R2)n\text{-} \quad (1)$$

$$R1\text{-}(NHCOO—R2)n\text{-} \quad (2)$$

$$R1\text{-}(OCONH—R2)n\text{-} \quad (3)$$

wherein n represent an integer not less than 3; R1 represents an aromatic or an aliphatic organic group; and R2 represents a group derived from a polyester resin formed at least one of polycarboxylic acid and polyol or an isocyanate-modified polyester resin.

The toner of the present invention preferably includes the resin for dispersing colorant. The resin for dispersing colorant is used to disperse a colorant in a binder resin of the toner.

The masterbatch is typically prepared by mixing and kneading a resin and a coloring agent for the masterbatch upon application of high shear stress thereto. In this case, an organic solvent can be used to boost the interaction of the coloring agent with the resin. In addition, flushing methods in which an aqueous paste including a coloring agent is mixed with a resin solution of an organic solvent to transfer the coloring agent to the resin solution and then the aqueous liquid and organic solvent are separated and removed can be preferably used because the resultant wet cake of the coloring agent can be used as it is without being dried. In this case, a high shear dispersion device such as a three-roll mill, etc. can be preferably used for kneading the mixture.

When a toner including a THF-insoluble polyester resin and a crystalline resin is prepared in an aqueous medium, a pigment tends to be unevenly distributed at the surface. A dispersion resin satisfying the following specific conditions covers the pigment in the toner, and the pigment is not drawn to the surface of the toner. Thus, the uneven distribution of the pigment is improved, and which suppresses the pigment from blocking heat conduction for fixing.

Specifically, the resin for dispersing colorant preferably has the following properties when dispersed or dissolved in ethylacetate.

(a) When the solution having a concentration of 20% by mass of the resin for dispersing colorant has a transmittance T (60)% for light of 500 nm at an optical path length of 1 cm 60 min later and a transmittance T (480)% 480 min later, T (60)%−T (480)%≥30% and T (480)% is not greater than 50%.

(b) Preferably in addition to (a), T (60)% is not less than 30%.

In a process of emulsifying or dispersing a toner composition liquid in which a colorant, a resin for dispersing colorant and a release agent are dissolved or dispersed in an organic solvent, the resin for dispersing colorant preferably produces a physical gel from associated molecule after dissolved or dispersed in the solution. The mechanically dispersed colorant is captured in the physical gel to suppress the colorant from reaggregating in the toner composition liquid and bleeding out in the toner. In the present invention, a method of seeing that the resin for dispersing colorant produces a physical gel includes seeing that T (60)%−T (480)%≥30% and T (480)% is not greater than 50% when the solution having a concentration of 20% by mass of the resin for dispersing colorant for light of 500 nm at an optical path length of 1 cm.

When T (60)%−T (480)% is lower than 30% or T (480)% is higher than 50%, the resin for dispersing colorant has high solubility and does not sufficiently form a physical gel, resulting in having no effect of suppressing the colorant mechanically dispersed when preparing a toner composition liquid from reaggregating. When T (60)%−T (480)% is lower than 30%, the resin for dispersing colorant has low solubility and a firm physical gel is formed, resulting in deterioration of colorability.

Specific examples of the resin for dispersing colorant include binder resins mentioned later satisfying the above (a) and (b), (co)polymers of the binder resins mentioned later and other monomers such as an amorphous polyester resin, polymer of styrene or substitution thereof (e.g., polystyrene, poly-p-chlorostyrene, and polyvinyl toluene); styrene copolymer (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-methyl vinyl ketone copolymer, styrene-butadiene copolymer, styrene-isoprene copolymer, styrene-acrylonitrile-indene copolymer, styrene-maleic acid copolymer, and styrene-maleic acid ester copolymer); and others including polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, a terpene resin, an aliphatic or alicyclic hydrocarbon resin, an aromatic petroleum resin, chlorinated paraffin, and paraffin wax. These may be used alone or in combination. Copolymers monomers constituting the binder resins mentioned later and other monomers can also be used.

The masterbatch preferably includes the resin for dispersing colorant in an amount of from 50% by mass to 95% by mass, and the toner preferably includes the resin for dispersing colorant in an amount of from 6% by mass to 60% by mass. When the masterbacth includes the resin in an amount less than 50% by mass and the toner less than 6% by mass, a pigment which is not mixed with the resin for dispersing colorant comes out, resulting in no effect for pigment dispersibility. When the masterbacth greater than 95% by mass and the toner greater than 60% by mass, the toner includes the resin too much, resulting in influence upon thermophysical properties of the toner and a problem in fixing.

<Method of Measuring Transmittance of Solution of Resin for Dispersing Colorant>

Twenty (20) g of the resin for dispersing colorant is added to 80 g of ethylacetate readily controlled to have a temperature of 40° C., and dissolved by an oscillator. After the resin is unseen, the solution is left in a thermostatic tank having a temperature of 40° C. for 60 min and 480 min. A sample of each of the solutions of the resin for dispersing colorant is placed in a glass cell having an optical path length of 1 cm to directly measure the transmittance of light of 500 nm by a spectrophotometer V-660 from JASCO Corp.

[Toner]

The toner of the present invention includes at least a polyester resin, preferably a crystalline polyester resin as a binder resin, and a colorant. Other components are further included when necessary.

In the present invention, the polyester resin preferably has one of the following formulae (1) to (3), and the toner preferably includes trivalent aliphatic isocyanate as a THF-insoluble matter. The polyester resin preferably has one of the following formulae (1) to (3) largely improves glossiness and image density of the toner forming a sea-island structure.

The toner of the present invention has only to include one of the polyester resins having the formulae (1) to (3). The toner may include one of the polyester resins having the formulae (1) to (3) alone or in combination with another (a second) polyester resin.

A method of lowering a glass transition temperature or decreasing a molecular weight of a polyester resin such as an amorphous polyester resin so as to melt with a crystalline polyester resin is thought to improve low-temperature fixability. However, when the glass transition temperature or the molecular weight of a polyester resin is simply lowered or decreased to lower melt viscosity thereof, it is easily conceivable that the toner deteriorates in heat resistant preservability and hot offset resistance when fixed.

The polyester resin in the toner of the present invention includes a branch structure in a molecular skeleton with a urethane or a urea bond. Including a molecular chain having a three-dimensional network structure, the polyester resin deforms at low temperature but does not fluidize like a rubber. Therefore, even when the polyester resin has so low a glass transition temperature, the toner can keep heat resistant preservability and hot offset resistance.

When the network structure is not uniform, coarse network causes deterioration of heat resistant preservability because the resin is not sufficiently prevented to fluidize, and dense network causes deterioration of low-temperature fixability and image glossiness because the resin has insufficient deformability.

Figure 6:
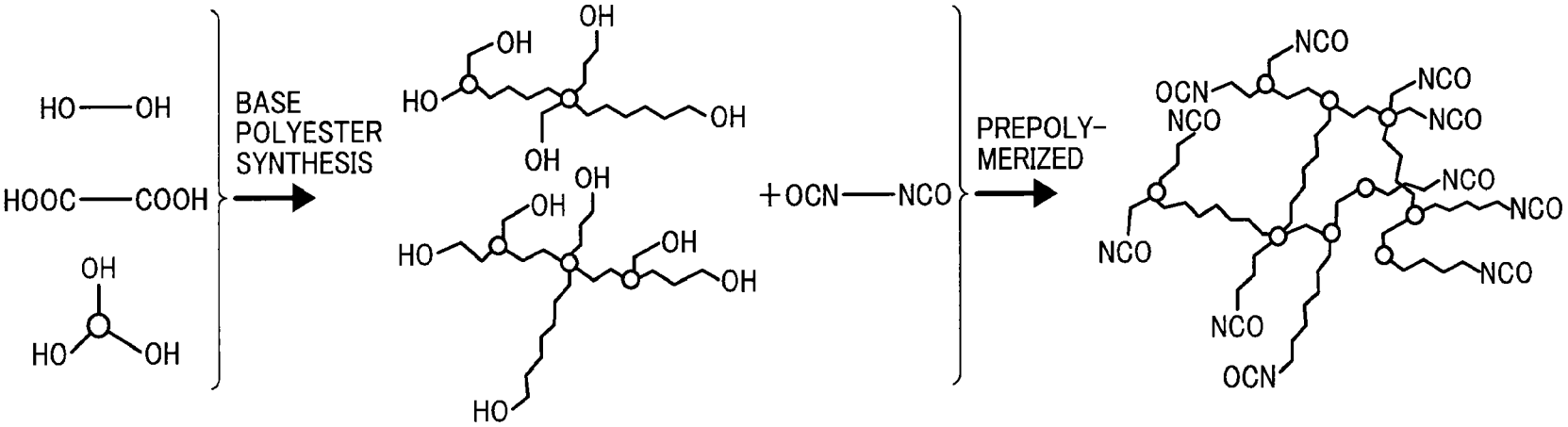
FIG. 6 is a schematic view illustrating a conventional amorphous polyester resin having a branch structure.

For example, Japanese Patent No. JP-5408210-B2 (Japanese published unexamined application No. JP-2013-054178-A) discloses a polyester resin in which a branch has an ester structure, i.e., when R2 in any one of the formulae (1) to (3) has a branch structure. As FIG. 6 shows, the branch structures are unevenly present, resulting in unsatisfactory low-temperature fixability and image glossiness. FIG. 6 is a schematic view illustrating a conventional amorphous polyester resin having a branch structure.

The conventional polyester resin is difficult to have all of good low-temperature fixability, good image glossiness, good heat resistant preservability and good hot offset resistance.

However, in the present invention, after R2 which is a polyester resin or a modified polyester resin is synthesized, R1 and a urethane group or a urea group are bonded with each other to from a network structure. When R2 has a narrow molecular weight distribution, the network can be uniformed.

Figure 7:
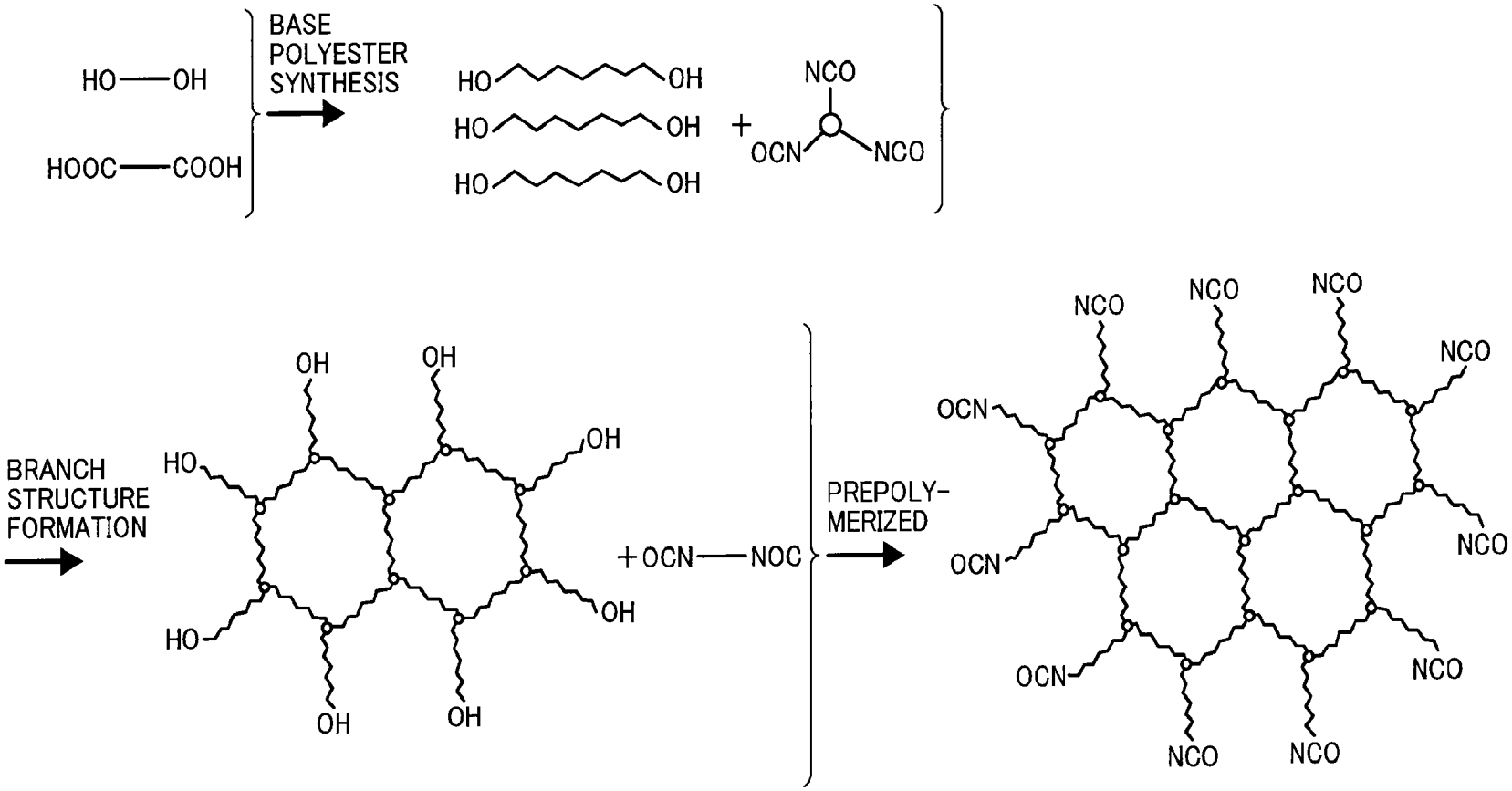
FIG. 7 is a schematic view illustrating a branch structure of the polyester resin of the present invention.

The state of the polyester resin having any one of the formulae (1) to (3) is shown in FIG. 7. FIG. 7 is a schematic view illustrating a branch structure of the polyester resin of the present invention. Since straight chain polyester resin at R2 has uniform length, the polyester resin has uniform branch structures as FIG. 7 shows.

The network structure of the polyester resin is uniformed for the toner to have heat resistant preservability, low-temperature fixability, good image glossiness and hot offset resistance.

Further, having a urethane bond or a urea bond having high aggregation energy at the branch structure, the polyester resin behaves as a strong crosslinking point. Fluidity of the resin is effectively suppressed even when the resin has coarser network structure, and the toner has heat resistant preservability, low-temperature fixability, good image glossiness and hot offset resistance.

<<Means for Separating Toner Constituent Components>>

One example of a separation unit for each component during an analysis of the toner will be specifically explained hereinafter.

First, 1 g of a toner is added to 100 mL THF, and the resulting mixture is stirred for 30 min at 25° C., to thereby obtain a solution in which soluble components are dissolved.

The solution is then filtered through a membrane filter having an opening of 0.2 μm, to thereby obtain THF soluble matter in the toner.

Next, the THF soluble matter are dissolved in THF, to thereby prepare a sample for measurement of GPC, and the prepared sample is supplied to GPC used for molecular weight measurement of each resin mentioned above.

Meanwhile, a fraction collector is disposed at an eluate outlet of GPC, to fraction the eluate per a certain count. The eluate is obtained per 5% in terms of the area ratio from the elution onset on the elution curve (raise of the curve).

Next, each eluted fraction, as a sample, in an amount of 30 mg is dissolved in 1 mL of deuterated chloroform, and to this solution, 0.05% by volume of tetramethyl silane (TMS)

is added as a standard material. A glass tube for NMR having a diameter of 5 mm is charged with the solution, from which a spectrum is obtained by a nuclear magnetic resonance apparatus (JNM-AL 400, product of JEOL Ltd.) by performing multiplication 128 times at temperature of from 23° C. to 25° C.

The monomer compositions and the compositional ratios of the polyester resin and the crystalline polyester resin in the toner are determined from peak integral ratios of the obtained spectrum.

For example, peaks are grouped as follows, and a component ratio of constitutional monomers is determined from an integrated ratio of each of the group.

Near 8.25 ppm: from a benzene ring of trimellitic acid (one hydrogen atom)

Near 8.07 ppm to 8.10 ppm: from a benzene ring of terephthalic acid (4 hydrogen atoms)

Near 7.1 ppm to 7.25 ppm: from a benzene ring of bisphenol A (4 hydrogen atoms)

Near 6.8 ppm: from a benzene ring of bisphenol A (4 hydrogen atoms) and a double bond of fumaric acid (2 hydrogen atoms)

Near 5.2 ppm to 5.4 ppm: from methylene of an adduct of bisphenol A with propylene oxide (one hydrogen atom)

Near 3.7 ppm to 4.7 ppm: from methylene of an adduct of bisphenol A with propylene oxide (2 hydrogen atoms) and methylene of an adduct of bisphenol A with ethylene oxide (4 hydrogen atoms)

Near 1.6 ppm: from a methyl group of bisphenol A (6 hydrogen atoms)

From these results, for example, an abstract collected in a fraction occupied by the polyester resin having any one of the formulae (1) to (3) by not less than 90% can be regarded as the polyester resin having any one of the formulae (1) to (3).

Similarly, an abstract collected in a fraction occupied by the other polyester resin by not less than 90% can be regarded as the other polyester resin.

An abstract collected in a fraction occupied by the crystalline polyester resin by not less than 90% can be regarded as the crystalline polyester resin.

(THF-insoluble Matter)

The toner preferably includes a THF-insoluble matter in an amount of from 3 parts by mass to 20 parts by mass, and more preferably from 5 parts by mass to 11 parts by mass. When less than 3 parts by mass, the toner may deteriorate in low-temperature fixability. When greater than 20 part by mass, the toner may deteriorate in heat resistant preservability.

The THF-insoluble matter is a nonlinear polyester resin. Although the toner has a glass transition temperature (Tg) lower those of conventional toners, the toner can sufficiently keep heat resistant preservability by including a specific amount of the THF-insoluble matter. Particularly, when the amorphous polyester resin includes a urethane bond or a urea bond having high aggregating force, the effect of keeping heat resistant preservability is noticeable.

The THF-insoluble matter of the toner can be obtained as follows.

After 1 part of the toner is added to 40 parts of tetrahydrofuran (THF) and circulated therein for 6 hrs, an insoluble matter is precipitated by a centrifugal separator to separate the insoluble matter from a supernatant liquid.

The insoluble matter is dried at 40° C. for 20 hrs to obtain a THF-insoluble matter.

<Polyester Resin>

The polyester resin preferably has any one of the formulae (1) to (3), and a structure in which a R2 which is a polyester resin or a modified polyester resin and R1 which is a branch structure are bonded with each other by a urethane group or a urea group.

The polyester resin includes at least a urethane bond or a urea bond at the branch structure. The urethane bond or the urea bond behaves like a pseudo crosslinked point, and the polyester resin is more like a rubber. Consequently, the resultant toner has better heat resistant preservability and hot offset resistance.

In the formulae (1) to (3), n is more preferably 3.

In the formulae (1) to (3), R1 preferably has an organic group having less carbon atoms because it is easy to uniform the network structure. An aliphatic or an aromatic organic group having not greater than 20 carbon atoms is preferably used. The organic group of R1 may include an ester bond. The organic group of R1 is preferably an aliphatic compound or an aliphatic compound including an ester bond to control aggregation force at the crosslinked point in a suitable range and have both high glossiness and heat resistant preservability.

The polyester resin preferably includes a diol component, and more preferably includes a dicarboxylic acid.

The polyester resin is preferably an amorphous polyester resin.

The polyester resin is not particularly limited as long as the polyester resin has a structure in which a R2 which is a polyester resin or a modified polyester resin and R1 which is a branch structure are bonded with each other by a urethane group or a urea group. Methods of bonding R1 and R2 include, but are not limited to, the following 3 methods.

(i) A diol component and a dicarboxylic acid component are subjected to esterification reaction to prepare polyester polyol (R2) having a hydroxyl group at an end, and the polyester polyol is reacted with tri- or higher valent polyisocyanate (R1).

(ii) A diol component and a dicarboxylic acid component are subjected to esterification reaction to prepare polyester polyol (R2) having a hydroxyl group at an end, the polyester polyol is reacted with divalent polyisocyanate to prepare isocyanate-modified polyester (R2), and the isocyanate-modified polyester is reacted with tri- or higher valent alcohol (R1).

(iii) A diol component and a dicarboxylic acid component are subjected to esterification reaction to prepare polyester polyol (R2) having a hydroxyl group at an end, the polyester polyol is reacted with divalent polyisocyanate to prepare isocyanate-modified polyester (R2), and the isocyanate-modified polyester is reacted with tri- or higher valent polyisocyanate (R1).

A hydroxyl group remaining in polyol obtained in any one of (i) to (iii) is further reacted with di- or more valent polyisocyanate to prepare a polyester prepolymer, which is usable with a curing agent in a process of preparing toner.

The polyester resin includes diol to lower the Tg and easily deform at low temperature. The diol preferably includes aliphatic diol having 3 to 12 carbon atoms, and more preferably from 4 to 12 carbon atoms. The polyester resin preferably includes the aliphatic diol having 3 to 12 carbon atoms in an amount not less than 50% by mol, more preferably not less than 80% by mol, and furthermore preferably not less than 90% by mol.

Specific examples of the aliphatic diol having 3 to 12 carbon atoms include 1,3-propanediol, 1,4-butanediol, 2-methyl-1,3-propane diol, 1,5-pentanediol, 3-methyl-1,5-pentane diol, 1,6-hexanediol, 1,8-octanediol, 1,10-decanediol, 1,12-dodecanediol, etc. Particularly, the diol is preferably aliphatic diol having 4 to 12 carbon atoms, in which the main chain has an odd number of carbon atoms and the side chain has an alkyl group. The aliphatic diol having 4 to 12 carbon atoms, in which the main chain has an odd number of carbon atoms and the side chain has an alkyl group includes. e.g., aliphatic diol having the following formula (1).

$$HO—(CR^1R^2)n\text{-}OH \quad (1)$$

wherein $R^1$ and $R^2$ independently represent a hydrogen atom or an alkyl group having 1 to 3 carbon atoms; n represents an odd number of from 3 to 9; $R^1$ may be the same or different from each other in n repeat units; and $R^2$ may be the same or different from each other in n repeat units.

The polyester resin preferably includes aliphatic diol having 3 to 12 carbon atoms in an amount not less than 50% by mol based on total mol of alcohol to lower the Tg and easily deform at low temperature.

The polyester resin preferably includes dicarboxylic acid having 4 to 12 carbon atoms in an amount not less than 30% by mol to lower the Tg and easily deform at low temperature. Specific examples of the dicarboxylic acid having 4 to 12 carbon atoms include succinic acid, glutaric acid, adipic acid, pimelic acid, suberic acid, azelaic acid, sebacic acid, dodecanedioic acid, etc.

—Diol Component—

Specific examples of the diol include, but are not limited to, aliphatic diols such as ethylene glycol, 1,2-propylene glycol, 1,3-propylene glycol, 1,4-butanediol, and 1,6-hexanediol, 1,8-octanediol, 1,10-decanediol and 1,12-dodecanediol; diols having an oxy alkylene group such as diethylene glycol, triethylene glycol, dipropylene glycol, polyethylene glycol, polypropylene glycol and polytetramethylene; alicyclic diol such as 1,4-cyclohexanedimethanol and hydrogenated bisphenol A; adducts of the above-mentioned alicyclic diol with an alkylene oxide such as ethylene oxide, propylene oxide and butylene oxide; bisphenols such as bisphenol A, bisphenol F and bisphenol S; and adducts of the above-mentioned bisphenol with an alkylene oxide such as ethylene oxide, propylene oxide and butylene oxide. In particular, aliphatic diols having 4 to 12 carbon atoms are preferably used.

These diols can be used alone or in combination.

—Dicarboxylic Acid Component—

Specific examples of the dicarboxylic acid include, but are not limited to, aliphatic dicarboxylic acids and aromatic dicarboxylic acids. Their anhydrides, lower (having 1 to 3 carbon atoms) alkyl esterified compounds and halogenated compounds may be used. These dicarboxylic acids can be used alone or in combination.

Specific examples of the aliphatic dicarboxylic acids include, but are not limited to, succinic acid, adipic acid, sebacic acid, dodecanedioic acid, maleic acid and fumaric acid.

Specific examples of the aromatic dicarboxylic acid include, but are not limited to, aromatic dicarboxylic acids having 8 to 20 carbon atoms such as phthalic acid, isophthalic acid, terephthalic acid, naphthalene dicarboxylic acid.

Among these, aliphatic dicarboxylic acids having 4 to 12 carbon atoms are preferably used.

These may be used alone or in combination.

—Tri- or Higher Valent Alcohol—

The tri- or higher valent alcohol includes, e.g., tri- or higher valent aliphatic alcohol, tri- or higher valent polyphenol and adducts of the tri- or higher valent polyphenol with an alkylene oxide. Specific examples of the tri- or higher valent aliphatic alcohol include, but are not limited to, glycerin, trimethylolethane, trimethylolpropane, pentaerythritol and sorbitol.

Specific examples of the tri- or higher valent polyphenol include, but are not limited to, trisphenol PA, phenolnovolak and cresolnovolak.

Specific examples of the adducts of the tri- or higher valent polyphenol with an alkylene oxide include, but are not limited to, adducts of the tri- or higher valent polyphenol with an alkylene oxide such as ethylene oxide, propylene oxide and butylene oxide.

—Polyisocyanate—

The polyisocyanate is not particularly limited and may be appropriately selected depending on the intended purpose. Examples thereof include diisocyanate, and tri- or higher valent isocyanate. These polyisocyanates may be used alone or in combination.

Specific examples of the diisocyanate include, but are not limited to, aliphatic diisocyanate; alicyclic diisocyanate; aromatic diisocyanate; aromatic aliphatic diisocyanate; isocyanurate; and a block product thereof where the foregoing compounds are blocked with a phenol derivative, oxime, or caprolactam.

Specific examples of the tri- or higher valent isocyanate include, but are not limited to, lysine triisocyanate or tri- or higher valent alcohol reacted with diisocyanate.

Specific examples of the aliphatic diisocyanate include, but are not limited to, tetramethylene diisocyanate, hexamethylene diisocyanate, 2,6-diisocyanato methyl caproate, octamethylene diisocyanate, decamethylene diisocyanate, dodecamethylene diisocyanate, tetra decamethylene diisocyanate, trimethyl hexane diisocyanate, tetramethyl hexane and diisocyanate.

Specific examples of the alicyclic diisocyanate include, but are not limited to, isophorone diisocyanate and cyclohexylmethane diisocyanate.

Specific examples of the aromatic diisocyanate include, but are not limited to, tolylene diisocyanate, diisocyanato diphenyl methane, 1,5-nephthylene diisocyanate, 4,4'-diisocyanato diphenyl, 4,4'-diisocyanato-3,3'-dimethyldiphenyl, 4,4'-diisocyanato-3-methyldiphenyl methane and 4,4'-diisocyanato-diphenyl ether.

Specific examples of the aromatic aliphatic diisocyanate include, but are not limited to, α,α,α',α'-tetramethylxylene diisocyanate.

Specific examples of the isocyanurate include, but are not limited to, tris(isocyanatoalkyl)isocyanurate and tris(isocyanatocycloalkyl)isocyanurate.

—Curing Agent—

The curing agent is not particularly limited and may be appropriately selected depending on the intended purpose, so long as it can react with the polyester prepolymer (a reaction product between the polyester resin R2 and the polyisocyanate, i.e., a precursor reactive with the curing agent). Examples thereof include an active hydrogen group-containing compound.

—Active Hydrogen Group-Containing Compound—

An active hydrogen group in the active hydrogen group-containing compound is not particularly limited and may be appropriately selected depending on the intended purpose. Examples thereof include a hydroxyl group (e.g., an alcoholic hydroxyl group, and a phenolic hydroxyl group), an amino group, a carboxyl group, and a mercapto group. These may be used alone or in combination.

The active hydrogen group-containing compound is preferably amines, because it can form a urea bond.

Specific examples of the amines include, but are not limited to, diamine, trivalent or higher amine, amino alcohol, amino mercaptan, amino acid and compounds in which the amino groups of the foregoing compounds are blocked. These may be used alone or in combination Among them, diamine, and a mixture of diamine and a small amount of tri- or higher valent amine are preferably used.

Specific examples of the diamine include, but are not limited to, aromatic diamine, alicyclic diamine and aliphatic diamine.

Specific examples of the aromatic diamine include, but are not limited to, phenylenediamine, diethyl toluene diamine and 4,4'-diaminodiphenylmethane.

Specific examples of the alicyclic diamine include, but are not limited to, 4,4'-diamino-3,3'-dimethyldicyclohexyl methane, diamino cyclohexane and isophoronediamine.

Specific examples of the aliphatic diamine include, but are not limited to, ethylene diamine, tetramethylene diamine and hexamethylenediamine.

Specific examples of the tri- or higher valent amine include, but are not limited to, diethylenetriamine and triethylene tetramine.

Specific examples of the amino alcohol include, but are not limited to, ethanol amine and hydroxyethyl aniline.

Specific examples of the amino mercaptan include, but are not limited to, aminoethyl mercaptan and aminopropyl mercaptan.

Specific examples of the amino acid include, but are not limited to, amino propionic acid and amino caproic acid.

Specific examples of the compound where the amino group is blocked include, but are not limited to, a ketimine compound where the amino group is blocked with ketone such as acetone, methyl ethyl ketone, methyl isobutyl ketone and an oxazoline compound.

(Glass Transition Temperature)

The polyester resin preferably has a glass transition temperature of from −60° C. to 0° C., and more preferably from −40° C. to −20° C.

When lower than −60° C., the fluidity of the toner at low temperature is uncontrollable, resulting in deterioration of heat resistant preservability and filming resistance. When higher than 0° C., the toner is not sufficiently deformed with heat and pressure when fixed, resulting in insufficient low-temperature fixability.

<<Methods of Measuring Melting Point and Glass Transition Temperature (Tg)>>

In the present invention, a melting point and a glass transition temperature (Tg) of the toner can be measured, for example, by a differential scanning calorimeter (DSC) system (Q-200, product of TA Instruments Japan Inc.).

Specifically, a melting point and a glass transition temperature of samples can be measured in the following manners.

Specifically, first, an aluminum sample container charged with about 5.0 mg of a sample is placed on a holder unit, and the holder unit is then set in an electric furnace. Next, the sample is heated (first heating) from −80° C. to 150° C. at the heating rate of 10° C./min in a nitrogen atmosphere. Then, the sample is cooled from 150° C. to −80° C. at the cooling rate of 10° C./min, followed by again heating (second heating) to 150° C. at the heating rate of 10° C./min. DSC curves are respectively measured for the first heating and the second heating by a differential scanning calorimeter (Q-200, product of TA Instruments Japan Inc.).

The DSC curve for the first heating is selected from the obtained DSC curve by an analysis program stored in the Q-200 system, to thereby determine a glass transition temperature of the sample with the first heating. Similarly, the DSC curve for the second heating is selected, and the glass transition temperature of the sample with the second heating can be determined. In the present invention, the glass transition temperature of the sample in the second heating is a Tg of each of the samples.

(Weight-Average Molecular Weight)

A weight-average molecular weight of the polyester resin is not particularly limited and may be appropriately selected depending on the intended purpose, but preferably from 20,000 to 1,000,000 as measured by GPC.

The weight-average molecular weight of the polyester resin is a molecular weight of a reaction product between the reactive precursor and the curing agent.

When less than 20,000, the toner is likely to be fluid at low temperature and may deteriorate in heat resistant preservability. In addition, the toner has low viscosity when melted and may deteriorate in hot offset resistance.

<Another Polyester Resin>

The another (a second) polyester resin includes a diol component and a dicarboxylic acid component.

The another polyester resin is different from the polyester resins having the formulae (1) to (3).

The another polyester resin is preferably an amorphous polyester resin.

In addition, the another polyester resin is preferably a linear polyester resin.

Further, the another polyester resin is preferably an unmodified polyester resin.

The unmodified polyester resin is obtained by using a polyol; and a polycarboxylic acid such as a polycarboxylic acid, a polycarboxylic acid anhydride and a polycarboxylic acid ester or its derivatives, and is not modified by an isocyanate compound.

Examples of the polyol include diols.

Specific examples of the diols include alkylene (having 2 to 3 carbon atoms) oxide (average addition molar number is 1 to 10) adduct of bisphenol A such as polyoxypropylene (2,2)-2,2-bis(4-hydroxyphenyl)propane, and polyoxyethylene(2,2)-2,2-bis(4-hydroxyphenyl)propane; ethyleneglycol, propyleneglycol; and hydrogenated bisphenol A, and alkylene (having 2 to 3 carbon atoms) oxide (average addition molar number is 1 to 10) adduct of hydrogenated bisphenol A.

These may be used alone or in combination.

Examples of the polycarboxylic acid include dicarboxylic acid. Specific examples of the dicarboxylic acid include: adipic acid, phthalic acid, isophthalic acid, terephthalic acid, fumaric acid, maleic acid; and succinic acid substituted by an alkyl group having 1 to 20 carbon atoms or an alkenyl group having 2 to 20 carbon atoms such as dodecenylsuccinic acid and octylsuccinic acid.

These may be used alone or in combination. The another polyester resin may include a tri- or higher valent carboxylic acid and/or a tri- or higher valent alcohol at the end of the resin chain to adjust an acid value and a hydroxyl value.

Specific examples of the tri- or higher valent carboxylic acid include trimellitic acid, pyromellitic acid, their acid anhydrides, etc.

Specific examples of the tri- or higher valent alcohol include glycerin, pentaerythritol, trimethylol propane, etc.

A molecular weight of the amorphous polyester resin B is not particularly limited and may be appropriately selected depending on the intended purpose. However, when the molecular weight thereof is too low, heat resistant preservability of the toner and durability against stress such as stirring in an image developer may be deteriorated. When the molecular weight thereof is too high, viscoelasticity of the toner during melting may be high, and thus low-temperature fixability of the toner may be deteriorated. Thus, a weight-average molecular weight (Mw) thereof is preferably 3,000 to 10,000, and more preferably from 4,000 to 7,000 as measured by GPC (gel permeation chromatography).

A number-average molecular weight (Mn) thereof is preferably 1,000 to 4,000, and more preferably from 1,500 to 3,000.

Moreover, Mw/Mn thereof is preferably 1.0 to 4.0, and more preferably from 1.0 to 3.5.

The another polyester resin preferably has an acid value of from 1 to 50 mg KOH/g, and more preferably 5 to 30 mg KOH/g.

When the acid value thereof is not less than 1 mg KOH/g, the resultant toner may be negatively charged. In addition, the resultant toner has good affinity between paper and the toner when fixed on the paper, and thus low-temperature fixability of the toner may be improved. Meanwhile, when the acid value is greater than 50 mg KOH/g, the resultant toner may be deteriorated in charging stability, especially charging stability against environmental change.

A hydroxyl value of the another polyester resin is not particularly limited and may be appropriately selected depending on the intended purpose. The hydroxyl value thereof is preferably mot less than 5 mg KOH/g.

A glass transition temperature (Tg) of the amorphous polyester resin B is preferably from 40° C. to 70° C., more preferably from 50° C. to 60° C.

When the glass transition temperature thereof is less than 40° C., the resultant toner has poor heat resistant preservability and durability against stress such as stirring in the developing unit, and the resultant toner has poor filming resistance. Meanwhile, when the glass transition temperature thereof is greater than 70° C., the deformation of the toner with heat and pressurization during fixing is insufficient, resulting in poor low-temperature fixability.

(Analysis of the Formulae (1) to (3))

A molecular structure when the polyester resin having any one of the formulae (1) to (3) is used alone or combined with the another polyester resin can be confirmed by solution-state or solid-state NMR, X-ray diffraction, GC/MS, LC/MS, or IR spectroscopy. Simple methods for confirming the molecular structure thereof include a method for detecting, as the polyester resin, one that does not have absorption based on δCH (out-of-plane bending vibration) of olefin at 965 $cm^{-1}$±10 $cm^{-1}$ and 990 $cm^{-1}$±10 $cm^{-1}$ in an infrared absorption spectrum.

The content of the polyester resin having any one of the formulae (1) to (3) when used alone or combined with the another polyester resin is not particularly limited and may be appropriately selected depending on the intended purpose. The toner preferably includes the polyester resin having any one of the formulae (1) to (3) in an amount of from 5 to 25 parts by mass, and more preferably from 10 to 20 parts by mass when combined with the another polyester resin. When less than 5 parts by mass, the toner may deteriorate in low-temperature fixability and hot offset resistance. When greater than 25 parts by mass, the toner may deteriorate in heat-resistance preservability and glossiness of images after fixed. When the amount thereof is within more preferable range than the aforementioned range, it is advantageous that the resultant toner is excellent in both high image quality and low-temperature fixability.

Meanwhile, the toner preferably includes the another polyester resin in an amount of from 50 to 90 parts by mass, and more preferably from 60 to 80 parts by mass. When less than 50 parts by mass, a pigment and a release agent in the toner may deteriorate in dispersibility, resulting in foggy images and image distortion. When greater than 90 by mass, the toner includes crystalline polyester resin mentioned later or the polyester resin having any one of the formulae (1) to (3) less, and may deteriorate in low-temperature fixability. When the amount thereof is within more preferable range than the aforementioned range, it is advantageous that the resultant toner is excellent in both high image quality and low-temperature fixability.

<Crystalline Polyester Resin>

Having high crystallinity, the crystalline polyester resin has heat meltability quickly having viscosity at around a fixation starting temperature. When the crystalline polyester resin having such properties is used together with the amorphous polyester resin, the toner has good heat resistant preservability due to crytallinity just before a melt starting temperature. At the melt starting temperature, the toner quickly decreases in viscosity (sharp meltability) due to melting of the crystalline polyester resin. Then, the crystalline polyester resin is compatible with the polyester resin, and they quickly decrease in viscosity together to obtain a toner having good heat resistant preservability and low-temperature fixability. In addition, a release width (a difference between a fixable minimum temperature and a temperature at which hot offset occurs) has a good result.

The crystalline polyester resin is obtained by polymerizing polyols and polycarboxylic acids and their derivatives such as polycarboxylic acids, polycarboxylic acid anhydride and polycarboxylic acid esters.

Modified polyester resins such as the prepolymer and resins obtained by crosslinking and/or elongating the prepolymer do not belong to the crystalline polyester resin.

In the present invention, crystallinity of the crystalline polyester resin can be confirmed by a crystal analysis X-ray diffractometer X' Pert Pro MRD from Philips N.V. as follows.

First, a sample is ground in a mortar to prepare a powder thereof. The sample powder is uniformly applied on a sample holder. The sample holder is set in the diffractometer to obtain a diffraction spectrum.

When a peak half width of the maximum peak intensity within a range of the diffraction peaks $20° < 2\theta < 25°$ is not greater than 2.0, the polyester resin is judged to have crystallinity.

A polyester resin having no such a property is called an amorphous polyester resin in the present invention.

Conditions of the X-ray diffraction analysis are as follows.

Tension kV: 45 kV
Current: 40 mA
MPSS
Upper
Gonio
Scanmode: continuous
Start angle: 3°
End angle: 35°
Angle Step: 0.02°
Lucident beam optics
Divergence slit: Div slit ½
Difflection beam optics
Anti scatter slit: As Fixed ½
Receiving slit: Prog rec slit —Polyol—

The polyol is not particularly limited and may be appropriately selected depending on the intended purpose. Examples thereof include diol, and tri- or higher valent alcohol.

Specific examples of the diol include saturated aliphatic diol, etc. Specific examples of the saturated aliphatic diol include straight chain saturated aliphatic diol, and branched-chain saturated aliphatic diol. Among them, straight chain saturated aliphatic diol is preferably used, and straight chain saturated aliphatic diol having 2 to 12 carbon atoms is more preferably used. When the saturated aliphatic diol has a branched-chain structure, crystallinity of the crystalline polyester resin may be low, and thus may lower the melting point. When the number of carbon atoms in the saturated aliphatic diol is greater than 12, it may be difficult to yield a material in practice. The number of carbon atoms is preferably not greater than 12.

Specific examples of the saturated aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosanedecanediol, etc. Among them, ethylene glycol, 1,4-butanediol, 1,6-hexanediol, 1,8-octanediol, 1,10-decanediol, and 1,12-dodecanediol are preferably used, as they give high crystallinity to a resulting crystalline polyester resin, and give excellent sharp melt properties.

Specific examples of the tri- or higher valent alcohol include glycerin, trimethylol ethane, trimethylolpropane, pentaerythritol, etc. These may be used alone or in combination.

—Polycarboxylic Acid—

The multivalent carboxylic acid is not particularly limited and may be appropriately selected depending on the intended purpose. Examples thereof include divalent carboxylic acid, and tri- or higher valent carboxylic acid.

Specific examples of the divalent carboxylic acid include saturated aliphatic dicarboxylic acids such as an oxalic acid, a succinic acid, a glutaric acid, an adipic acid, a suberic acid, an azelaic acid, a sebacic acid, a 1,9-nonanedicarboxylic acid, a 1,10-decanedicarboxylic acid, a 1,12-dodecanedicarboxylic acid, a 1,14-tetradecanedicarboxylic acid, and a 1,18-octadecanedicarboxylic acid; aromatic dicarboxylic acids of dibasic acid such as a phthalic acid, an isophthalic acid, a terephthalic acid, a naphthalene-2, 6-dicarboxylic acid, a malonic acid, a and mesaconic acid; and anhydrides of the foregoing compounds, and lower (having 1 to 3 carbon atoms) alkyl ester of the foregoing compounds, etc.

Specific examples of the tri- or higher valent carboxylic acid include 1,2,4-benzenetricarboxylic acid, 1,2,5-benzenetricarboxylic acid, 1,2,4-naphthalene tricarboxylic acid, anhydrides thereof, and lower (having 1 to 3 carbon atoms) alkyl esters thereof, etc.

Moreover, the polycarboxylic acid may contain, other than the saturated aliphatic dicarboxylic acid or aromatic dicarboxylic acid, dicarboxylic acid containing a sulfonic acid group. Further, the polycarboxylic acid may contain, other than the saturated aliphatic dicarboxylic acid or aromatic dicarboxylic acid, dicarboxylic acid having a double bond. These may be used alone or in combination.

The crystalline polyester resin is preferably composed of a straight chain saturated aliphatic dicarboxylic acid having 4 to 12 carbon atoms and a straight chain saturated aliphatic diol having 2 to 12 carbon atoms. Namely, the crystalline polyester resin preferably includes a structural unit coming from a saturated aliphatic dicarboxylic acid having 4 to 12 carbon atoms and a structural unit coming from a saturated aliphatic diol having 2 to 12 carbon atoms. As a result of this, the crystalline polyester resin has high crystallinity and good sharp meltability, and the resultant toner has good low-temperature fixability.

A melting point of the crystalline polyester resin is not particularly limited and may be appropriately selected depending on the intended purpose, but it is preferably 60° C. to 80° C. When the melting point thereof is less than 60° C., the crystalline polyester resin tends to melt at low temperature, which may impair heat resistant preservability of the toner. When the melting point thereof is greater than 80° C., melting of the crystalline polyester resin with heat applied during fixing may be insufficient, which may impair low-temperature fixability of the toner.

A molecular weight of the crystalline polyester resin is not particularly limited and may be appropriately selected depending on the intended purpose. Since those having a sharp molecular weight distribution and low molecular weight have excellent low-temperature fixability, and heat resistant preservability of the resultant toner lowers as an amount of a low molecular weight component, an o-dichlorobenzene soluble component of the crystalline polyester resin preferably has the weight average molecular weight (Mw) of 3,000 to 30,000, number average molecular weight (Mn) of 1,000 to 10,000, and Mw/Mn of 1.0 to 10, as measured by GPC. Further, it is more preferred that the weight average molecular weight (Mw) thereof be 5,000 to 15,000, the number average molecular weight (Mn) thereof be 2,000 to 10,000, and the Mw/Mn be 1.0 to 5.0.

An acid value of the crystalline polyester resin is not particularly limited and may be appropriately selected depending on the intended purpose, but it is preferably not less than 5 mg KOH/g, more preferably not less than 10 mg KOH/g for achieving the desired low-temperature fixability in view of affinity between paper and the resin. Meanwhile, the acid value thereof is preferably 45 mg KOH/g or lower for the purpose of improving hot offset resistance.

A hydroxyl value of the crystalline polyester resin is not particularly limited and may be appropriately selected depending on the intended purpose. However, it is preferably 0 to 50 mg KOH/g, more preferably 5 to 50 mg KOH/g, in order to achieve the desired low-temperature fixability and excellent charging property.

A molecular structure of the crystalline polyester resin can be confirmed by solution-state or solid-state NMR, X-ray diffraction, GC/MS, LC/MS, or IR spectroscopy. Simple methods for confirming the molecular structure thereof include a method for detecting, as a crystalline polyester resin, one that has absorption based on δCH (out-of-plane bending vibration) of olefin at 965 $cm^{-1}$±10 $cm^{-1}$ and 990 $cm^{-1}$±10 $cm^{-1}$ in an infrared absorption spectrum.

The content of the crystalline polyester resin is not particularly limited and may be appropriately selected depending on the intended purpose, but it is preferably 3 to 20 parts by mass, more preferably 5 to 15 parts by mass, relative to 100 parts by mass of the toner. When the amount thereof is less than 3 parts by mass, the crystalline polyester resin is insufficient in sharp melt property, and thus the resultant may be deteriorated in heat resistant preservability. When it is greater than 20 parts by mass, the resultant toner may be deteriorated in heat resistant preservability, and fogging of an image may be caused. When the amount thereof is within more preferable range than the aforementioned range, it is advantageous that the resultant toner is excellent in both high image quality and low-temperature fixability.

<Colorant>

The colorant is appropriately selected depending on the intended purpose without any limitation, and examples thereof include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazine lake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone.

The content of the colorant is not particularly limited and may be appropriately selected depending on the intended purpose, but it is preferably 1 to 15 parts by mass, more preferably 3 to 10 parts by mass, relative to 100 parts by mass of the toner.

<Other Components>

Examples of the aforementioned other components include a release agent, a colorant, a charge controlling agent, an external additive, a fluidity improver, a cleanability improver, and a magnetic material.

—Release Agent—

The release agent is appropriately selected from those known in the art without any limitation.

Specific examples of wax serving as the release agent include natural wax such as vegetable wax (e.g., carnauba wax, cotton wax, Japan wax and rice wax), animal wax (e.g., bees wax and lanolin), mineral wax (e.g., ozokelite and ceresine) and petroleum wax (e.g., paraffin wax, microcrystalline wax and petrolatum).

Specific examples of the wax other than the above natural wax include a synthetic hydrocarbon wax (e.g., Fischer-Tropsch wax and polyethylene wax; and a synthetic wax (e.g., ester wax, ketone wax and ether wax).

Further, other examples of the release agent include fatty acid amides such as 12-hydroxystearic acid amide, stearic amide, phthalic anhydride imide and chlorinated hydrocarbons; low-molecular-weight crystalline polymers such as acrylic homopolymers (e.g., poly-n-stearyl methacrylate and poly-n-lauryl methacrylate) and acrylic copolymers (e.g., n-stearyl acrylate-ethyl methacrylate copolymers); and crystalline polymers having a long alkyl group as a side chain.

Among them, a hydrocarbon wax such as a paraffin wax, a microcrystalline wax, a Fischer-Tropsch wax, a polyethylene wax, and a polypropylene wax is preferably used.

A melting point of the release agent is not particularly limited and may be appropriately selected depending on the intended purpose, but it is preferably 60° C. to 80° C. When the melting point thereof is less than 60° C., the release agent tends to melt at low temperature, which may impair heat resistant preservability. When the melting point thereof is greater than 80° C., the release agent does not sufficiently melt to thereby cause fixing offset, even in the case where the resin is in the fixing temperature range, which may cause defects in an image.

The content of the release agent is appropriately selected depending on the intended purpose without any limitation, but it is preferably 2 to 10 parts by mass, more preferably 3 to 8 parts by mass, relative to 100 parts by mass of the toner. When the amount thereof is less than 2 parts by mass, the resultant toner may have insufficient hot offset resistance, and low-temperature fixability during fixing. When the amount thereof is greater than 10 parts by mass, the resultant toner may have insufficient heat resistant preservability, and tends to cause fogging in an image. When the content thereof is within the aforementioned more preferable range, it is advantageous because image quality and fixing stability can be improved.

—Charge Controlling Agent—

The charge controlling agent is not particularly limited and may be appropriately selected depending on the intended purpose. Examples thereof include a nigrosine-based dye, a triphenylmethane-based dye, a chromium-containing metallic complex dye, a molybdic acid chelate pigment, a rhodamine-based dry, alkoxy-based amine, a quaternary ammonium salt (including a fluorine-modified quaternary ammonium salt), alkylamide, a simple substance or a compound of phosphorus, a simple substance or a compound of tungsten, a fluorine-based activator, a salicylic acid metallic salt, a metallic salt of salicylic acid derivative, etc.

Specific examples thereof include a nigrosine dye BONTRON 03, a quaternary ammonium salt BONTRON P-51, a metal-containing azo dye BONTRON S-34, an oxynaphthoic acid-based metal complex E-82, a salicylic acid-based metal complex E-84 and a phenol condensate E-89 (all products of ORIENT CHEMICAL INDUSTRIES CO., LTD.); quaternary ammonium salt molybdenum complexes TP-302 and TP-415 (all products of Hodogaya Chemical Co., Ltd.); LRA-901; a boron complex LR-147 (product of Japan Carlit Co., Ltd.); a copper phthalocyanine; perylene; quinacridone; an azo-pigment; and polymeric compounds having, as a functional group, a sulfonic acid group, carboxyl group, quaternary ammonium salt, etc.

The content of the charge controlling agent is not particularly limited and may be appropriately selected depending on the intended purpose, but it is preferably 0.1 to 10 parts by mass, more preferably 0.2 to 5 parts by mass, relative to 100 parts by mass of the toner. When the amount thereof is greater than 10 parts by mass, the charging ability of the toner becomes excessive, which may reduce the effect of the charge controlling agent, increase electrostatic force to a developing roller, leading to low flowability of the developer, or low image density of the resulting image.

These charge controlling agents may be dissolved and dispersed after being melted and kneaded together with the master batch, and/or resin. The charge controlling agents can be, of course, directly added to an organic solvent when dissolution and dispersion is performed. Alternatively, the charge controlling agents may be fixed on surfaces of toner particles after the production of the toner particles.

—External Additive—

The external additive include oxide fine particles, and which can be combined with inorganic fine particles or hydrophobized inorganic fine particles.

The hydrophobized inorganic fine particles preferably have an average primary particle diameter of from 1 to 100 nm, and more preferably from 5 to 70 nm, and preferably include inorganic fine particles having an average primary particle diameter not greater than 20 nm and inorganic fine particles having an average primary particle diameter not less than 30 nm. The hydrophobized inorganic fine particles preferably have a BET specific surface area of from 20 to 500 $m^2/g$.

Specific examples of the other fine particles include, but are not limited to, hydrophobic silica; aliphatic acid metal salts such as zing stearate and aluminum stearate; metal oxides such as titania, alumina, tin oxide and antimony oxide; and fluoropolymers.

Particularly, hydrophobized silica fine particles, hydrophobized titanium oxide fine particles and hydrophobized alumina fine particles are preferably used. Examples of the hydrophobized titanium oxide particles include: T-805 (product of Nippon Aerosil Co., Ltd.); STT-30A, STT-65S-S (both products of Titan Kogyo, Ltd.); TAF-500T, TAF-1500T (both products of Fuji Titanium Industry Co., Ltd.); MT-100S, MT-100T (both products of TAYCA CORPORATION); and IT-S (product of ISHIHARA SANGYO KAISHA, LTD.).

The hydrophobized silica particles, hydrophobized titania particles, and hydrophobized alumina particles can be obtained, for example, by treating hydrophilic particles with a silane coupling agent, such as methyltrimethoxy silane, methyltriethoxy silane, and octyltrimethoxy silane. Moreover, silicone oil-treated oxide particles, or silicone oil-treated inorganic particles, which have been treated by adding silicone oil optionally with heat, are also suitably used as the external additive.

Examples of the silicone oil include dimethyl silicone oil, methylphenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, methacryl-modified silicone oil, and α-methylstyrene-modified silicone oil.

Specific examples of the inorganic particles include silica, alumina, titanium oxide, barium titanate, magnesium titanate, calcium titanate, strontium titanate, iron oxide, copper oxide, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. Among them, silica and titanium dioxide are preferably used.

The content of the external additive is not particularly limited and may be appropriately selected depending on the intended purpose, but it is preferably 0.1 to 5 parts by mass, more preferably 0.3 to 3 parts by mass, relative to 100 parts by mass of the toner.

The inorganic fine particles preferably have an average primary particle diameter, but is not limited to, not greater than 100 nm, and more preferably from 3 to 70 nm.

—Fluidity Improver—

The fluidity improver is not particularly limited and may be appropriately selected depending on the intended purpose so long as it is capable of performing surface treatment of the toner to increase hydrophobicity, and preventing degradations of flow properties and charging properties of the toner even in a high humidity environment. Examples thereof include a silane-coupling agent, a sililation agent, a silane-coupling agent containing a fluoroalkyl group, an organic titanate-based coupling agent, an aluminum-based coupling agent, silicone oil, and modified silicone oil. It is particularly preferred that the silica or the titanium oxide be used as hydrophobic silica or hydrophobic titanium oxide treated with the aforementioned flow improving agent.

—Cleanability Improver—

The cleanability improver is not particularly limited and may be appropriately selected depending on the intended purpose so long as it can be added to the toner for the purpose of removing the developer remaining on a photoconductor or a primary transfer member after transferring. Examples thereof include: fatty acid metal salt such as zinc stearate, calcium stearate, and stearic acid; and polymer particles produced by soap-free emulsion polymerization, such as polymethyl methacrylate particles, and polystyrene particles. The polymer particles are preferably those having a relatively narrow particle size distribution, and the polymer particles having the volume average particle diameter of 0.01 to 1 μm are preferably used.

—Magnetic Material—

The magnetic material is not particularly limited and may be appropriately selected depending on the intended purpose. Examples thereof include iron powder, magnetite, and ferrite. Among them, a white magnetic material is preferable in terms of a color tone.

<Glass Transition Temperature and Melting Point of Toner>

(Glass Transition Temperature (Tg1st))

A glass transition temperature (Tg1st) of the toner is preferably from 20° C. to 50° C. where the glass transition temperature (Tg1st) is a glass transition temperature measured in first heating of differential scanning calorimetry (DSC) of the toner.

In conventional toners, when a Tg thereof is about not greater than 50° C., the conventional toners tend to cause aggregation of toner particles because it is influenced by temperature variations during transportation or storage of the toner in summer or in a tropical region. As a result, the toner particles are solidified in a toner bottle, or adherence of the toner particles may be caused within a developing unit. Moreover, supply failures due to clogging of the toner in the toner bottle, and formation of defected images due to adherence of the toner may be caused.

A toner of the present invention tends to have a lower Tg than the conventional toners. However, since the polyester resin having any one of the formulae (1) to (3) is non-linear, the toner of the present invention can retain heat resistant preservability. In particular, when the polyester resin having any one of the formulae (1) to (3) has a urethane bond or a urea bond responsible for high aggregation force, the resultant toner may significantly exhibit more excellent effects in heat resistant preservability.

When the Tg1st is less than 20° C., the toner may be deteriorated in heat resistant preservability, and blocking within a developing unit and filming on a photoconductor may be caused. When the Tg1st is greater than 50° C., low-temperature fixability of the toner may be deteriorated.

It is preferable that the polyester resin preferably includes the polyester resin having any one of the formulae (1) to (3) and the another polyester resin, and that the toner including the polyester resin preferably has a Tg1st of from 20° C. to 50° C.

A difference (Tg1st−Tg2nd) is not particularly limited and may be appropriately selected depending on the intended purpose, but preferably not less than 10° C. An upper limit of the difference is not particularly limited and may be appropriately selected depending on the intended purpose, but the difference is preferably not greater than 50° C. It is preferable that the toner further includes a crystalline polyester resin besides the polyester resin, and that the toner including them has a difference (Tg1st−Tg2nd) not less than 10° C.

When the difference (Tg1st−Tg2nd) is not less than 10° C., the toner has better low-temperature fixability. The difference (Tg1st−Tg2nd) not less than 10° C. means the crystalline polyester and the polyester resin are compatible with each other after the first heating, which have been present incompatible with each other before the first heating. They do not have to completely be compatible with each other after heated.

A melting point of the toner is particularly limited and may be appropriately selected depending on the intended purpose, but preferably from 60° C. to 80° C.

<Volume-Average Particle Diameter of Toner>

The volume-average particle diameter of the toner is not particularly limited and may be appropriately selected depending on the intended purpose, but it is preferably 3 μm to 7 μm. Moreover, a ratio of the volume average particle diameter to the number average particle diameter is preferably not greater than 1.2. Further, the toner preferably contains toner particles having the volume average particle diameter of 2 μm or less, in an amount of 1% by number to 10% by number.

<Calculation Methods and Analysis Methods of Various Properties of Toner and Constituent Component of Toner>

A SP value, a Tg, an acid value, a hydroxyl value, a molecular weight, and a melting point of the polyester resin, the crystalline polyester resin, and the release agent may be each measured. Alternatively, each component may be separated from an actual toner by gel permeation chromatography (GPC) or the like, and each of the separated components may be subjected to the analysis methods described hereinafter, to thereby determine physical properties such as a SP value, a Tg, a molecular weight, a melting point, and a weight ratio of constituent components.

Separation of each component by GPC can be performed, for example, by the following method.

In GPC measurement using THF (tetrahydrofuran) as a mobile phase, an eluate is subjected to fractionation by a fraction collector, a fraction corresponding to a part of a desired molecular weight is collected from a total area of an elution curve.

The combined eluate is concentrated and dried by an evaporator or the like, and a resulting solid content is dissolved in a deuterated solvent, such as deuterated chloroform, and deuterated THF, followed by measurement of $^{1}$H-NMR. From an integral ratio of each element, a ratio of a constituent monomer of the resin in the elution composition is calculated.

As another method, after concentrating the eluate, hydrolysis is performed with sodium hydroxide or the like, and a ratio of a constituent monomer is calculated by subjecting the decomposed product to a qualitative and quantitative analysis by high performance liquid chromatography (HPLC).

Note that, in the case where the toner is produced by generating the polyester resin through a chain-elongation reaction and/or crosslink reaction of the non-linear reactive precursor and the curing agent to thereby produce toner base particles, the polyester resin may be separated from an actual toner by GPC or the like, to thereby determine a Tg thereof. Alternatively, the toner may be produced by synthesizing the polyester resin through a chain-elongation reaction and/or crosslink reaction of the non-linear reactive precursor and the curing agent, to thereby measure a Tg thereof from the synthesized polyester resin.

<Toner Production Method>

A method for producing the toner is not particularly limited and may be appropriately selected depending on the intended purpose, but the toner is preferably granulated by dispersing an oil phase including the polyester resin, preferably the crystalline resin, and further including the release agent, the colorant, etc. when necessary in an aqueous medium. Particularly, the polyester resin preferably includes the polyester resin having any one of the formulae (1) to (3) and the another polyester resin.

The toner is more preferably granulated by dispersing an oil phase including the polyester prepolymer (a reaction product between the polyester resin R2 and the polyisocyanate, i.e., a precursor reactive with the curing agent), the another polyester resin having no urethane or urea bond, preferably the crystalline polyester resin, and further including the curing agent, the release agent, the colorant, etc. when necessary in an aqueous medium The toner may be prepared by known dissolution suspension methods. As one example of the methods of preparing the toner base particle, a method for forming toner base particles while forming the polyester resin having any one of the formulae (1) to (3) through elongating reaction and/or cross-linking reaction between the prepolymer and the curing agent will be described hereinafter. This method includes preparing an aqueous medium, preparing an oil phase containing toner materials, emulsifying or dispersing the toner materials, and removing an organic solvent.

—Preparation of Aqueous Medium (Aqueous Phase)—

The preparation of the aqueous phase can be carried out, for example, by dispersing resin particles in an aqueous medium. An amount of the resin particles added to the aqueous medium is not particularly limited and may be appropriately selected depending on the intended purpose, but it is preferably 0.5 to 10 parts by mass relative to 100 parts by mass of the aqueous medium.

The aqueous medium is not particularly limited and may be appropriately selected depending on the intended purpose. Examples thereof include water, a solvent miscible with water, and a mixture thereof. These may be used alone or in combination of two or more thereof. Among them, water is preferable.

The solvent miscible with water is not particularly limited and may be appropriately selected depending on the intended purpose. Examples thereof include alcohol, dimethyl formamide, tetrahydrofuran, cellosolve, and lower ketone. The alcohol is not particularly limited and may be appropriately selected depending on the intended purpose. Examples thereof include methanol, isopropanol, and ethylene glycol. The lower ketone is not particularly limited and may be appropriately selected depending on the intended purpose. Examples thereof include acetone and methyl ethyl ketone.

—Preparation of Oil Phase—

Preparation of the oil phase containing the toner materials can be performed by dissolving or dispersing toner materials in an organic solvent, where the toner materials contain at least the non-linear reactive precursor, the amorphous polyester resin B and the crystalline polyester resin C, and further contain the curing agent, the release agent, the colorant, if necessary.

The organic solvent is not particularly limited and may be appropriately selected depending on the intended purpose, but it is preferably an organic solvent having a boiling point of less than 150° C., as removal thereof is easy.

The organic solvent having the boiling point of less than 150° C. is not particularly limited and may be appropriately selected depending on the intended purpose. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These may be used alone or in combination.

Among them, ethyl acetate, toluene, xylene, benzene, methylene chloride, 1,2-dichloroethane, chloroform, and carbon tetrachloride are particularly preferable, and ethyl acetate is more preferably used.

—Emulsification or Dispersion—

The emulsification or dispersion of the toner materials can be carried out by dispersing the oil phase containing the toner materials in the aqueous medium. In the course of the emulsification or dispersion of the toner materials, the curing agent and the non-linear reactive precursor allowed to carry out a chain-elongation reaction and/or crosslinking reaction to form the polyester resin having any one of the formulae (1) to (3).

The polyester resin having any one of the formulae (1) to (3) can be formed by, e.g., the following methods (1) to (3).

(1) A method of emulsifying or dispersing an oil phase including the non-linear reactive precursor and the curing agent in an aqueous medium and subjecting them to an elongation and/or a crosslinking reaction to form the polyester resin having any one of the formulae (1) to (3).

(2) A method of emulsifying or dispersing an oil phase including the non-linear reactive precursor in an aqueous medium the curing agent is previously added to and subjecting them to an elongation and/or a crosslinking reaction to form the polyester resin having any one of the formulae (1) to (3).

(3) A method of emulsifying or dispersing an oil phase including the non-linear reactive precursor in an aqueous medium, and then adding the curing agent in the aqueous medium and subjecting them to an elongation and/or a crosslinking reaction from a particle interface to form the polyester resin having any one of the formulae (1) to (3).

When the curing agent and the non-linear reactive precursor are subject to an elongation and/or a crosslinking reaction from a particle interface, the polyester resin having any one of the formulae (1) to (3) is preferentially formed on the surface of the toner, and density gradient of the polyester resin having any one of the formulae (1) to (3) can be formed in the toner.

When the curing agent and the non-linear reactive precursor are subject to an elongation and/or a crosslinking reaction from a particle interface, the polyester resin having any one of the formulae (1) to (3) is preferentially formed on the surface of the toner, and density gradient of the polyester resin having any one of the formulae (1) to (3) can be formed in the toner.

When the curing agent and the non-linear reactive precursor are subject to an elongation and/or a crosslinking reaction from a particle interface, the polyester resin having any one of the formulae (1) to (3) is preferentially formed on the surface of the toner, and density gradient of the polyester resin having any one of the formulae (1) to (3) can be formed in the toner.

The reaction conditions (reaction time and temperature) to form the polyester resin having any one of the formulae (1) to (3) are particularly limited and may be appropriately selected depending on a combination of the curing agent and the non-linear reactive precursor.

The reaction time is not particularly limited and may be appropriately selected depending on the intended purpose, but it is preferably from 10 min to 40 hrs, more preferably from 2 to 24 hrs.

The reaction temperature is not particularly limited and may be appropriately selected depending on the intended purpose, but it is preferably 0° C. to 150° C., more preferably 40° C. to 98° C.

A method for stably forming a dispersion liquid containing the polyester prepolymer in the aqueous medium is not particularly limited and may be appropriately selected depending on the intended purpose. Examples thereof include a method for dispersing an oil phase, which is added to an aqueous medium, with shear force, where the oil phase is prepared by dissolving or dispersing toner materials in a solvent.

A disperser used for the dispersing is not particularly limited and may be appropriately selected depending on the intended purpose. Examples thereof include a low-speed shearing disperser, a high-speed shearing disperser, a friction disperser, a high-pressure jetting disperser and an ultrasonic wave disperser.

Among them, the high-speed shearing disperser is preferable, because it can control the particle diameters of the dispersed elements (oil droplets) to the range of 2 to 20 μm.

In the case where the high-speed shearing disperser is used, the conditions for dispersing, such as the rotating speed, dispersion time, and dispersion temperature, may be appropriately selected depending on the intended purpose.

The rotational speed is not particularly limited and may be appropriately selected depending on the intended purpose, but it is preferably 1,000 to 30,000 rpm, more preferably 5,000 to 20,000 rpm.

The dispersion time is not particularly limited and may be appropriately selected depending on the intended purpose, but it is preferably 0.1 to 5 min in case of a batch system.

The dispersion temperature is not particularly limited and may be appropriately selected depending on the intended purpose, but it is preferably 0° C. to 150° C., more preferably 40° C. to 98° C. under pressure. Note that, generally speaking, dispersion can be easily carried out, as the dispersion temperature is higher.

An amount of the aqueous medium used for the emulsification or dispersion of the toner material is not particularly limited and may be appropriately selected depending on the intended purpose, but it is preferably 50 to 2,000 parts by mass, more preferably 100 to 1,000 parts by mass, relative to 100 parts by mass of the toner material.

When the amount of the aqueous medium is less than 50 parts by mass, the dispersion state of the toner material is impaired, which may result a failure in attaining toner base particles having desired particle diameters. When the amount thereof is more than 2,000 parts by mass, the production cost may increase.

When the oil phase containing the toner material is emulsified or dispersed, a dispersant is preferably used for the purpose of stabilizing dispersed elements, such as oil droplets, and gives a sharp particle size distribution as well as giving desirable shapes of toner particles.

The dispersant is not particularly limited and may be appropriately selected depending on the intended purpose. Examples thereof include a surfactant, a water-insoluble inorganic compound dispersant, and a polymer protective colloid. These may be used alone or in combination. Among them, the surfactant is preferably used.

The surfactant is not particularly limited and may be appropriately selected depending on the intended purpose. Examples thereof include an anionic surfactant, a cationic surfactant, a nonionic surfactant, and an amphoteric surfactant.

The anionic surfactant is not particularly limited and may be appropriately selected depending on the intended purpose. Examples thereof include alkyl benzene sulfonic acid salts, α-olefin sulfonic acid salts and phosphoric acid esters. Among them, those having a fluoroalkyl group are preferably used.

A catalyst can be used in the elongation and/or the crosslinking reaction when forming the polyester resin having any one of the formulae (1) to (3). The catalyst is not particularly limited and may be appropriately selected depending on the intended purpose. Examples thereof include dibutyltinoxide and dioctyltinoxide.

—Removal of Organic Solvent—

A method for removing the organic solvent from the dispersion liquid such as the emulsified slurry is not particularly limited and may be appropriately selected depending on the intended purpose. Examples thereof include: a method in which an entire reaction system is gradually heated to evaporate out the organic solvent in the oil droplets; and a method in which the dispersion liquid is sprayed in a dry atmosphere to remove the organic solvent in the oil droplets.

As the organic solvent removed, toner base particles are formed. The toner base particles can be subjected to washing and drying, and can be further subjected to classification. The classification may be carried out in a liquid by removing small particles by cyclone, a decanter, or centrifugal separator, or may be performed on particles after drying.

The obtained toner base particles may be mixed with particles such as the external additive or the charge controlling agent. At this time, by applying a mechanical impact during mixing, the external additive can be suppressed from falling off from surfaces of toner base particles.

Specific examples of methods of applying a mechanical impact include, but are not limited to, a method of applying an impact to the particles with a blade rotating at high speed, and a method of placing the particles in a high-speed airstream and accelerating them to collide with each other or an impact plate.

A device used for this method is appropriately selected depending on the intended purpose without any limitation, and examples thereof include ANGMILL (product of Hosokawa Micron Corporation), an apparatus produced by modifying I-type mill (product of Nippon Pneumatic Mfg. Co., Ltd.) to reduce the pulverizing air pressure, a hybridization system (product of Nara Machinery Co., Ltd.), a kryptron system (product of Kawasaki Heavy Industries, Ltd.) and an automatic mortar.

[Developer]

A developer of the present invention contains at least the toner, and may further contain appropriately selected other components, such as carrier, if necessary.

Accordingly, the developer has excellent transfer properties, and charging ability, and can stably form high quality images. Note that, the developer may be a one-component developer, or a two-component developer, but it is preferably a two-component developer when it is used in a high speed printer corresponding to recent high information processing speed, because the service life thereof can be improved.

In the case where the developer is used as a one-component developer, the diameters of the toner particles do not vary largely even when the toner is supplied and consumed repeatedly, the toner does not cause filming to a developing roller, nor fuse to a layer thickness regulating member such as a blade for thinning a thickness of a layer of the toner, and provides excellent and stable developing ability and image even when it is stirred in the developing device over a long period of time.

In the case where the developer is used as a two-component developer, the diameters of the toner particles in the developer do not vary largely even when the toner is supplied and consumed repeatedly, and the toner can provide excellent and stabile developing ability even when the toner is stirred in the developing device over a long period of time.

<Carrier>

The carrier is appropriately selected depending on the intended purpose without any limitation, but it is preferably a carrier containing a core, and a resin layer covering the core.

—Core Material—

A material of the core is appropriately selected depending on the intended purpose without any limitation, and examples thereof include a 50 to 90 emu/g manganese-strontium (Mn—Sr) material, and a 50 to 90 emu/g manganese-magnesium (Mn—Mg) material. To secure a sufficient image density, use of a hard magnetic material such as iron powder (100 emu/g or more), and magnetite (75 to 120 emu/g) is preferable. Moreover, use of a soft magnetic material such as a 30 to 80 emu/g copper-zinc material is preferable because an impact applied to a photoconductor by the developer born on a bearer in the form of a brush can be reduced, which is an advantageous for improving image quality.

These may be used alone or in combination.

The volume-average particle diameter of the core material is not particularly limited and may be appropriately selected depending on the intended purpose, but it is preferably 10 to 150 μm, more preferably 40 to 100 μm. When the volume average particle diameter thereof is less than 10 μm, the proportion of particles in the distribution of carrier particle diameters increases, causing carrier scattering because of low magnetization per carrier particle. When the volume average particle diameter thereof is more than 150 μm, the specific surface area reduces, which may cause toner scattering, causing reproducibility especially in a solid image portion in a full color printing containing many solid image portions.

In the case where the toner is used for a two-component developer, the toner is used by mixing with the carrier. An amount of the carrier in the two-component developer is not particularly limited and may be appropriately selected depending on the intended purpose, but it is preferably 90 to 98 parts by mass, more preferably 93 to 97 parts by mass, relative to 100 parts by mass of the two-component developer.

A developer of the present invention may be suitably used in image formation by various known electrophotographic methods such as a magnetic one-component developing method, a non-magnetic one-component developing method, and a two-component developing method.

(Image Forming Apparatus and Image Forming Method)

An image forming apparatus of the present invention includes at least an electrostatic latent image bearer, an electrostatic latent image forming unit, and a developing unit, and if necessary, further includes other units.

An image forming method of the present invention includes at least an electrostatic latent image forming step and a developing step, and if necessary, further includes other steps. The image forming method can preferably be executed by the image forming apparatus, the electrostatic latent image forming step can preferably be executed by the electrostatic latent image forming unit, the developing step can preferably be executed by the developing unit, and the other steps can preferably be executed by the other units.

(Developer Containing Unit)

The developer containing unit is the present invention is a unit containing a developer.

Embodiments of the developer containing unit include a developer container, an image developer and a process cartridge.

The developer container is a container containing a developer.

The image developer is a developing means containing a developer for development.

The process cartridge includes at least an image bearer and an image developer, and may include one of a charger, an irradiator and a cleaner, which is detachable from an image forming apparatus.

The image forming apparatus of the present invention includes a developer container accommodating the developer of the present invention. The container thereof is not particularly limited and may be appropriately selected from known containers. Examples thereof include those having a cap and a container main body.

A size, a shape, a structure and materials of the container main body are not particularly limited. The container main body preferably has, for example, a hollow-cylindrical shape. Particularly preferably, it is a hollow-cylindrical body whose inner surface has spirally-arranged concavo-convex portions some or all of which can accordion and in which the developer accommodated can be transferred to an outlet port through rotation. The materials for the developer-accommodating container are not particularly limited and are preferably those from which the container main body can be formed with high dimensional accuracy. Examples thereof include polyester resins, polyethylene resins, polypropylene resins, polystyrene resins, polyvinyl chloride resins, polyacrylic acids, polycarbonate resins, ABS resins and polyacetal resins.

The above developer accommodating container is excellent in easiness of storage and transportation and handling of the container. Therefore, it can be detachably attached to the below-described process cartridge and image forming apparatus, and can be used for supplying a developer.

<Electrostatic Latent Image Bearer>

The material, structure and size of the electrostatic latent image bearer are not particularly limited and may be appropriately selected depending on the intended purpose. Examples of the material thereof include inorganic photoconductors such as amorphous silicon and selenium and organic photoconductors such as polysilane and phthalopolymethine. Among them, amorphous silicon is preferable in terms of long lifetime.

The amorphous silicon photoconductor may be, for example, a photoconductor having a substrate and an electrically photoconductive layer of a-Si, which is formed on the substrate heated to 50° C. to 400° C. with a film forming method such as vacuum vapor deposition, sputtering, ion plating, thermal CVD (Chemical Vapor Deposition), photo-CVD or plasma CVD. Among them, plasma CVD is suitably employed, in which gaseous raw materials are decomposed through application of direct current or high-frequency or microwave glow discharge to form an a-Si deposition film on the substrate.

The shape of the electrostatic latent image bearer is not particularly limited and may be appropriately selected depending on the intended purpose, but it is preferably a hollow-cylindrical shape. The outer diameter of the electrostatic latent image bearer having a hollow-cylindrical shape is not particularly limited and may be appropriately selected depending on the intended purpose, but it is preferably 3 to 100 mm, more preferably 5 to 50 mm, particularly preferably 10 to 30 mm.

<Electrostatic Latent Image Forming Unit and Electrostatic Latent Image Forming Step>

The electrostatic latent image forming unit is not particularly limited and may be appropriately selected depending on the intended purpose so long as it is a unit configured to form an electrostatic latent image on the electrostatic latent image bearer. Examples thereof include a unit including at least a charging member configured to charge a surface of the electrostatic latent image bearer and an exposing member configured to imagewise expose the surface of the electrostatic latent image bearer to light.

The electrostatic latent image forming step is not particularly limited and may be appropriately selected depending on the intended purpose so long as it is a step of forming an electrostatic latent image on the electrostatic latent image bearer. The electrostatic latent image forming step can be performed using the electrostatic latent image forming unit by, for example, charging a surface of the electrostatic latent image bearer and then imagewise exposing the surface thereof to light.

—Charging Member and Charging—

The charging member is not particularly limited and may be appropriately selected depending on the intended purpose. Examples thereof include contact-type charging devices known per se having, for example, an electrically conductive or semiconductive roller, brush, film and rubber blade; and non-contact-type charging devices utilizing corona discharge such as corotron and scorotron.

The charging can be performed by, for example, applying voltage to the surface of the electrostatic latent image bearer by using the charging member.

The charging member may have any shape like a charging roller as well as a magnetic brush or a fur brush. The shape of the charging member may be suitably selected according to the specification or configuration of the image forming apparatus.

The charging member is not limited to the aforementioned contact-type charging members. However, the contact-type charging members are preferably used because an image forming apparatus in which an amount of ozone generated from the charging members is reduced can be obtained —Irradiation Member and Irradiation—

The irradiation member is not particularly limited and may be appropriately selected depending on the purpose so long as it attains desired imagewise irradiation on the surface of the electrophotographic latent image bearer charged with the charging member. Examples thereof include various irradiation members such as a copy optical irradiation device, a rod lens array irradiation device, a laser optical irradiation device, and a liquid crystal shutter irradiation device.

A light source used for the irradiation member is not particularly limited and may be appropriately selected depending on the intended purpose. Examples thereof include conventional light-emitting devices such as a fluorescent lamp, a tungsten lamp, a halogen lamp, a mercury lamp, a sodium lamp, a light-emitting diode (LED), a laser diode (LD), and an electroluminescence (EL) device.

Also, various filters may be used for emitting only light having a desired wavelength range. Examples of the filters include a sharp-cut filter, a band-pass filter, an infrared cut filter, a dichroic filter, an interference filter, and a color temperature conversion filter.

The irradiation can be performed by, for example, imagewise irradiating the surface of the electrostatic latent image bearer to light using the irradiation member.

In the present invention, light may be imagewise applied from the backside of the electrostatic latent image bearer.

<Developing Unit and Developing Step>

The developing unit is not particularly limited and may be appropriately selected depending on the intended purpose so long as it is a developing unit containing a toner for developing the electrostatic latent image formed on the electrostatic latent image bearer to thereby form a visible image.

The developing step is not particularly limited and may be appropriately selected depending on the intended purpose so long as it is a step of developing the electrostatic latent image formed on the electrostatic latent image bearer with a toner, to thereby form a visible image. The developing step can be performed by the developing unit.

The developing unit may be a dry or wet developing process, and may be a single-color or multi-color developing unit.

The developing unit is preferably a developing device containing: a stirring device for charging the toner with friction generated during stirring; a magnetic field-generating unit fixed inside; and a developer bearing member configured to bear a developer containing the toner on a surface thereof and to be rotatable.

In the developing unit, toner particles and carrier particles are stirred and mixed so that the toner particles are charged by friction generated therebetween. The charged toner particles are retained in the chain-like form on the surface of the rotating magnetic roller to form magnetic brushes. The magnetic roller is disposed proximately to the electrostatic latent image developing member and thus, some of the toner particles forming the magnetic brushes on the magnet roller are transferred onto the surface of the electrostatic latent image developing member by the action of electrically attractive force. As a result, the electrostatic latent image is developed with the toner particles to form a visible toner image on the surface of the electrostatic latent image developing member.

<Other Units and Other Steps>

Examples of the other units include a transfer unit, a fixing unit, a cleaning unit, a charge-eliminating unit, a recycling unit, and a controlling unit.

Examples of the other step include a transfer step, a fixing step, a cleaning step, a charge-eliminating step, a recycling step, and a controlling step.

—Transfer Unit and Transfer Step—

The transfer unit is not particularly limited and may be appropriately selected depending on the intended purpose so long as it is a unit configured to transfer the visible image onto a recording medium. Preferably, the transfer unit includes: a primary transfer unit configured to transfer the visible images to an intermediate transfer member to form a composite transfer image; and a secondary transfer unit configured to transfer the composite transfer image onto a recording medium.

The transfer step is not particularly limited and may be appropriately selected depending on the intended purpose so long as it is a step of transferring the visible image onto a recording medium. In this step, preferably, the visible images are primarily transferred to an intermediate transfer member, and the thus-transferred visible images are secondarily transferred to the recording medium.

For example, the transfer step can be performed using the transfer unit by charging the photoconductor with a transfer charger to transfer the visible image.

Here, when the image to be secondarily transferred onto the recording medium is a color image of several color toners, a configuration can be employed in which the transfer unit sequentially superposes the color toners on top of another on the intermediate transfer member to form an image on the intermediate transfer member, and the image on the intermediate transfer member is secondarily transferred at one time onto the recording medium by the intermediate transfer unit.

The intermediate transfer member is not particularly limited and may be appropriately selected from known transfer members depending on the intended purpose. For example, the intermediate transfer member is preferably a transferring belt.

The transfer unit (including the primary- and secondary transfer units) preferably includes at least a transfer device which transfers the visible images from the photoconductor onto the recording medium. Examples of the transfer device include a corona transfer device employing corona discharge, a transfer belt, a transfer roller, a pressing transfer roller and an adhesive transferring device.

The recording medium is not particularly limited and may be appropriately selected depending on the purpose, so long as it can receive a developed, unfixed image. Examples of the recording medium include plain paper and a PET base for OHP, with plain paper being used typically.

—Fixing Unit and Fixing Step—

The fixing unit is not particularly limited and may be appropriately selected depending on the intended purpose as long as it is a unit configured to fix a transferred image which has been transferred on the recording medium, but is preferably known heating-pressurizing members. Examples thereof include a combination of a heat roller and a press roller, and a combination of a heat roller, a press roller and an endless belt.

The fixing step is not particularly limited and may be appropriately selected depending on the intended purpose, as long as it is a step of fixing a visible image which has been transferred on the recording medium. The fixing step may be performed every time when an image of each color toner is transferred onto the recording medium, or at one time (at the same time) on a laminated image of color toners.

The fixing step can be performed by the fixing unit.

The heating-pressurizing member usually performs heating preferably at 80° C. to 200° C.

Notably, in the present invention, known photofixing devices may be used instead of or in addition to the fixing unit depending on the intended purpose.

A surface pressure at the fixing step is not particularly limited and may be appropriately selected depending on the intended purpose, but is preferably 10 N/cm$^2$ to 80 N/cm$^2$.

—Cleaning Unit and Cleaning Step—

The cleaning unit is not particularly limited and may be appropriately selected depending on the intended purpose, as long as it can remove the toner remaining on the photoconductor. Examples thereof include a magnetic brush cleaner, an electrostatic brush cleaner, a magnetic roller cleaner, a blade cleaner, a brush cleaner and a web cleaner.

The cleaning step is not particularly limited and may be appropriately selected depending on the intended purpose, as long as it is a step of removing the toner remaining on the photoconductor. It may be performed by the cleaning unit.

—Charge-Eliminating Unit and Charge-Eliminating Step—

The charge-eliminating unit is not particularly limited and may be appropriately selected depending on the intended purpose, as long as it is a unit configured to apply a charge-eliminating bias to the photoconductor to thereby charge-eliminate. Examples thereof include a charge-eliminating lamp.

The charge-eliminating step is not particularly limited and may be appropriately selected depending on the intended purpose, as long as it is a step of applying a charge-eliminating bias to the photoconductor to thereby charge-eliminate. It may be carried out by the charge-eliminating unit.

—Recycling Unit and Recycling Step—

The recycling unit is not particularly limited and may be appropriately selected depending on the intended purpose, as long as it is a unit configured to recycle the toner which has been removed at the cleaning step to the developing device. Example thereof includes a known conveying unit.

The recycling step is not particularly limited and may be appropriately selected depending on the intended purpose, as long as it is a step of recycling the toner which has been removed at the cleaning step to the developing device. The recycling step can be performed by the recycling unit.

—Control Unit and Control Step—

The control unit is not particularly limited and may be appropriately selected depending on the intended purpose, as long as it can control the operation of each of the above units. Examples thereof include devices such as sequencer and computer.

The control step is not particularly limited and may be appropriately selected depending on the intended purpose, as long as it is a step of controlling the operation of each of the above units. The control step can be performed by the control unit.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

One aspect of performing a method for forming an image using an image forming apparatus of the present invention will be explained with reference to FIG. 1. A color image forming apparatus 100A illustrated in FIG. 1 includes a photoconductor drum 10 (hereinafter may be referred to as "photoconductor 10") serving as the electrostatic latent image bearer, a charging roller 20 serving as the charging unit, an exposing device 30 serving as the exposing unit, a developing device 40 serving as the developing unit, an intermediate transfer member 50, a cleaning device 60 including a cleaning blade serving as the cleaning blade, and a charge-eliminating lamp 70 serving as the charge-eliminating unit.

The intermediate transfer member 50, which is an endless belt, is stretched around three rollers 51 disposed in the belt, and is designed to be movable in a direction indicated by the arrow. A part of three rollers 51 also functions as a transfer bias roller which can apply a predetermined transfer bias (primary transfer bias) to the intermediate transfer member 50. Near the intermediate transfer member 50, a cleaning device 90 including a cleaning blade is disposed. Also, a transfer roller 80 serving as the transfer unit which can apply a transfer bias onto a transfer paper 95 serving as the recording medium for transferring (secondary transferring) an developed image (toner image) is disposed facing the intermediate transfer member 50. Around the intermediate transfer member 50, a corona charging device 58 for applying a charge to the toner image on the intermediate transfer member 50 is disposed between a contact portion of the photoconductor 10 with the intermediate transfer member 50 and a contact portion of the intermediate transfer member 50 with the transfer paper 95 in a rotational direction of the intermediate transfer member 50.

The developing device 40 is composed of a developing belt 41 serving as the developer bearing member; and a black developing unit 45K, a yellow developing unit 45Y, a magenta developing unit 45M, and a cyan developing unit 45C, which are disposed around the developing belt 41. Note that, the black developing unit 45K includes a developer accommodating unit 42K, a developer supplying roller 43K, and a developing roller 44K. The yellow developing unit 45Y includes a developer accommodating unit 42Y, a developer supplying roller 43Y, and a developing roller 44Y. The magenta developing unit 45M includes a developer accommodating unit 42M, a developer supplying roller 43M, and a developing roller 44M. The cyan developing unit 45C includes a developer accommodating unit 42C, a developer supplying roller 43C, and a developing roller 44C. Moreover, the developing belt 41, which is an endless belt, is stretched so as to be movable around a plurality of belt rollers, and a part of the developing belt 41 contacts with the electrostatic latent image bearer 10.

In the color image forming apparatus 100 illustrated in FIG. 1, for example, the photoconductor drum 10 is uniformly charged by the charging roller 20. Then, the exposing device 30 imagewise exposes the photoconductor drum 10, to thereby form an electrostatic latent image. Next, the electrostatic latent image formed on the photoconductor drum 10 is developed by supplying a developer from the developing device 40, to thereby form a toner image. The toner image is transferred (primarily transferred) onto the intermediate transfer member 50, and is further transferred (secondary transferring) onto the transfer paper 95 by voltage applied from the roller 51. As a result, a transferred image is formed on the transfer paper 95. Note that, a residual toner remaining on the photoconductor 10 is removed by the cleaning device 60, and a charge on the photoconductor 10 is once eliminated by the charge-eliminating lamp 70.

Figure 2:
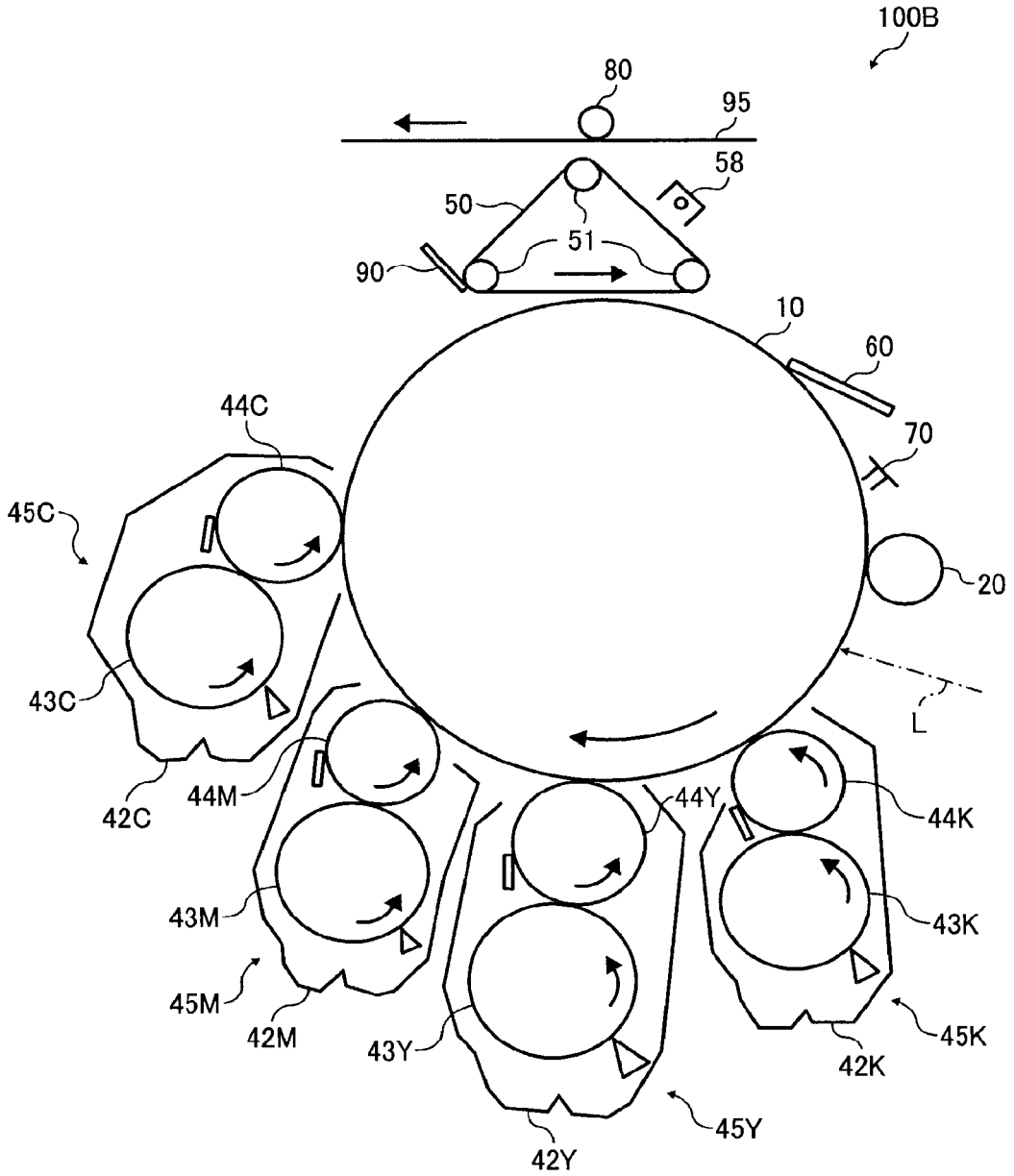
FIG. 2 is a schematic view illustrating another embodiment of the image forming apparatus of the present invention.

FIG. 2 is another example of an image forming apparatus of the present invention. An image forming apparatus 100B has the same configuration with the image forming apparatus 100A illustrated in FIG. 1, except that the developing belt 41 is not provided, and the black developing unit 45K, the yellow developing unit 45Y, the magenta developing unit 45M, and the cyan developing unit 45C are disposed directly facing the periphery of the photoconductor drum 10.

Figure 3:
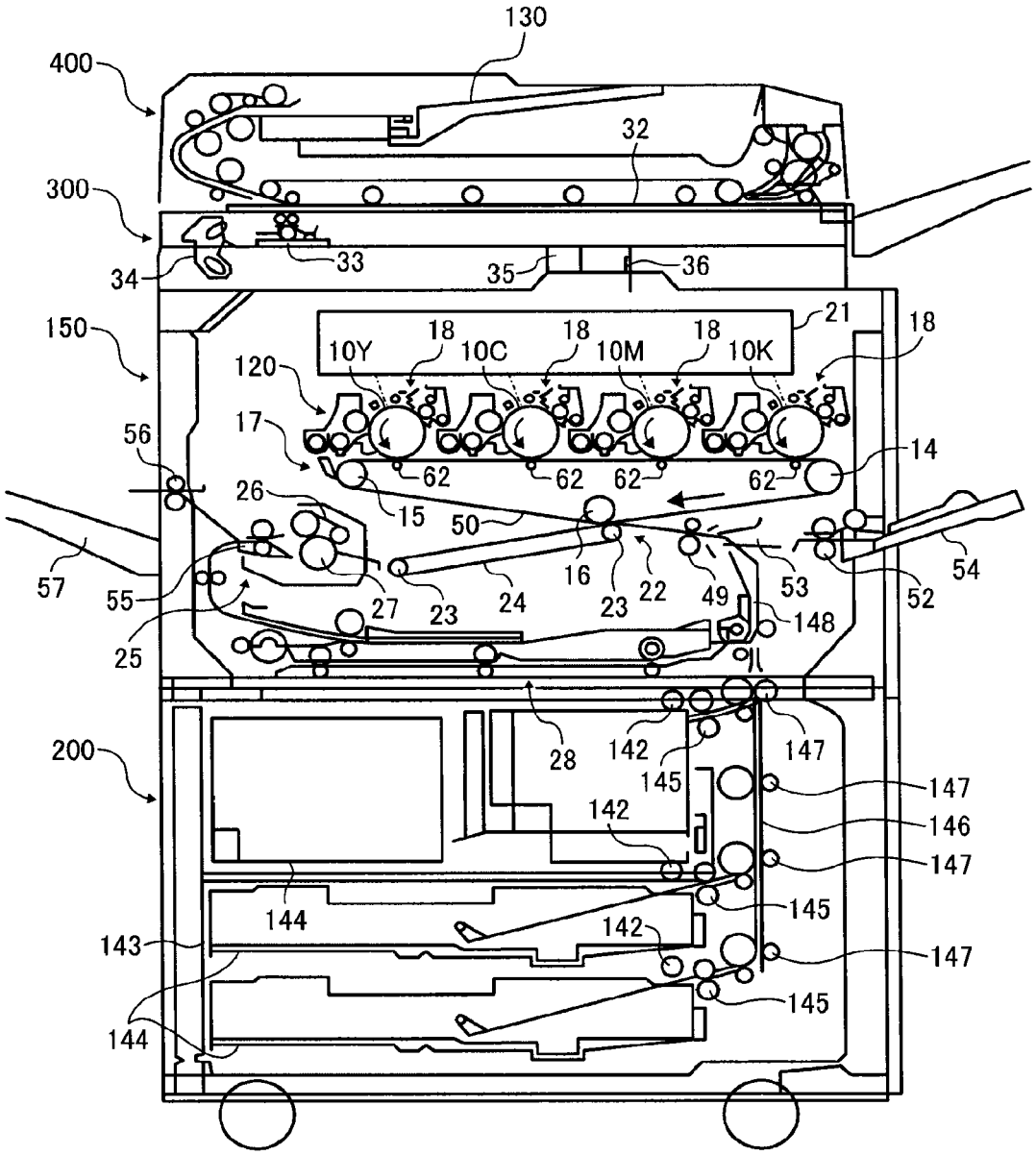
FIG. 3 is a schematic view illustrating a further embodiment of the image forming apparatus of the present invention.

FIG. 3 illustrates another example of an image forming apparatus of the present invention. The image forming apparatus illustrated in FIG. 3 includes a copying device main body 150, a paper feeding table 200, a scanner 300, and an automatic document feeder (ADF) 400.

An intermediate transfer member 50, which is an endless belt type, is disposed at a central part of the copying device main body 150. The intermediate transfer member 50 is stretched around support rollers 14, 15, and 16, and can rotate in a clockwise direction in FIG. 3. Near the support roller 15, an intermediate transfer member cleaning device 17 is disposed in order to remove a residual toner remaining on the intermediate transfer member 50. On the intermediate transfer member 50 stretched around the support roller 14 and the support roller 15, a tandem type developing device 120, in which four image forming units 18 of yellow, cyan, magenta, and black are arranged in parallel so as to face the intermediate transfer member 50 along a conveying direction, is disposed.

Near the tandem type developing device 120, an exposing device 21 serving as the exposing member is disposed. A secondary transfer device 22 is disposed on a side of the intermediate transfer member 50 opposite to a side where the tandem type developing device 120 is disposed. In the secondary transfer device 22, a secondary transfer belt 24, which is an endless belt, and is stretched around a pair of rollers 23. The transfer paper conveyed on the secondary transfer belt 24 and the intermediate transfer member 50 can contact each other. Near the secondary transfer device 22, a fixing device 25 serving as the fixing unit is disposed. The fixing device 25 includes a fixing belt 26 which is an endless belt, and a press roller 27 which is disposed so as to be pressed against the fixing belt 26.

Here, in the tandem type image forming apparatus, a sheet inverting device 28 configured to invert the transfer paper is disposed near the secondary transfer device 22 and the fixing device 25, in order to form an image on both sides of the transfer paper.

Next, a method for forming a full-color image (color-copying) using the tandem type developing device 120 will be explained. First, a color document is set on a document table 130 of the automatic document feeder (ADF) 400. Alternatively, the automatic document feeder 400 is opened, the color document is set on a contact glass 32 of the scanner 300, and the automatic document feeder 400 is closed.

When a start button (not illustrated) is pressed, the scanner 300 activates after the color document is conveyed and moved to the contact glass 32 in the case the color document has been set on the automatic document feeder 400, or right away in the case the color document has been set on the contact glass 32, so that a first travelling body 33 and a second travelling body 34 travel. At this time, light is irradiated from a light source in the first travelling body 33, the light reflected from a surface of the document is reflected by a mirror in the second travelling body 34 and then is received by a reading sensor 36 through an imaging forming lens 35. Thus, the color document (color image) is read to thereby form black, yellow, magenta and cyan image information.

Each image information of black, yellow, magenta, and cyan is transmitted to each of the image forming units 18 (black image forming unit, yellow image forming unit, magenta image forming unit, and cyan image forming unit) in the tandem type developing device 120, and the toner images of black, yellow, magenta, and cyan are each formed in the image forming units.

Figure 4:
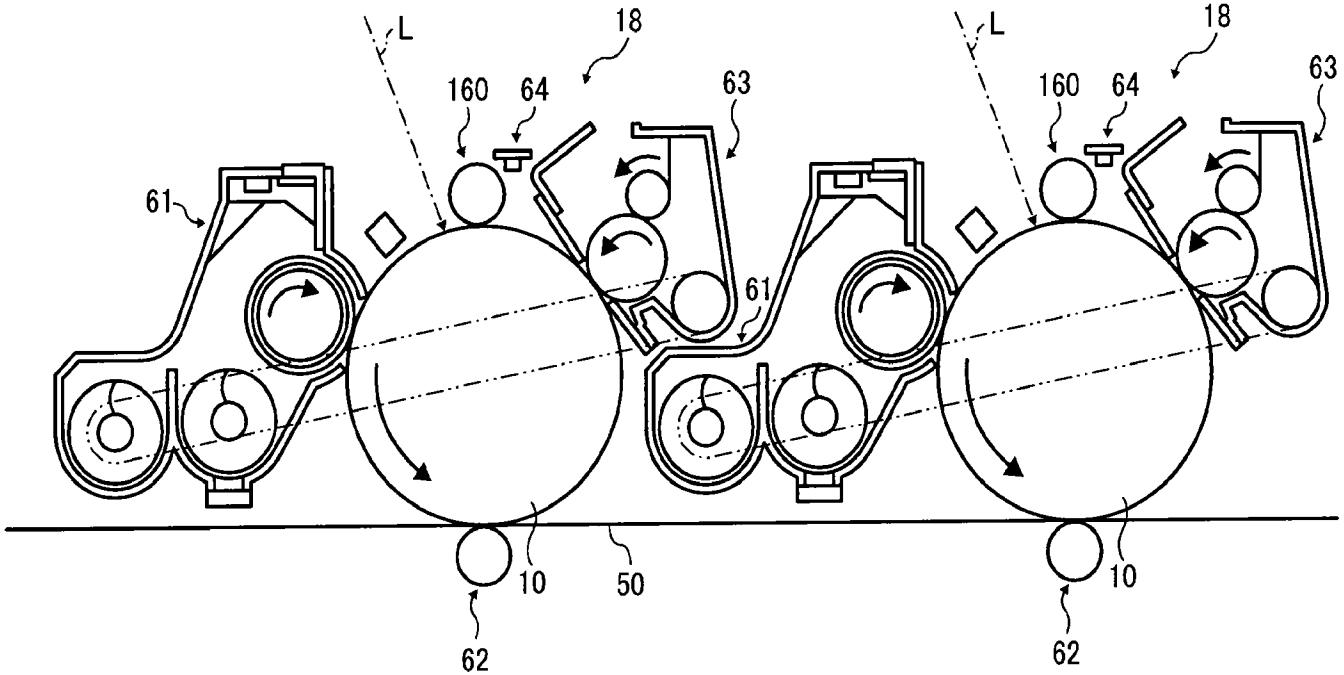
FIG. 4 is a schematic view illustrating a tandem developing device in FIG. 3.

The image forming units 18 (black image forming unit, yellow image forming unit, magenta image forming unit, and cyan image forming unit) in the tandem type developing device 120 include: electrostatic latent image bearers 10 (black electrostatic latent image bearer 10K, yellow electrostatic latent image bearer 10Y, magenta electrostatic latent image bearer 10M, and cyan electrostatic latent image bearer 10C); a charging device 160 configured to uniformly charge the electrostatic latent image bearers 10, serving as the charging unit; an exposing device configured to image-wise expose the electrostatic latent image bearers to light (L illustrated in FIG. 4) based on image information for each color, to form an electrostatic latent image corresponding to color images on the electrostatic latent image bearers; a developing device 61 configured to develop the electrostatic latent images with color toners (black toner, yellow toner, magenta toner, and cyan toner) to form a toner image of each of the color toners; a transfer charger 62 configured to transfer the toner image onto the intermediate transfer member 50; a cleaning device 63; and a charge-eliminating unit 64.

Each mage forming unit 18 can form a monochrome image (black image, yellow image, magenta image, and cyan image) based on image information of each color. Thus formed black image (i.e., black image formed onto the black electrostatic latent image bearer 10K), yellow image (i.e., yellow image formed onto the yellow electrostatic latent image bearer 10Y), magenta image (i.e., magenta image formed onto the magenta electrostatic latent image bearer 10M), and cyan image (i.e., cyan image formed onto the cyan electrostatic latent image bearer 10C) are sequentially transferred (primarily transferred) onto the intermediate transfer member 50 which is rotatably moved by the support rollers 14, 15 and 16. The black image, the yellow image, the magenta image, and the cyan image are superposed on top of one another on the intermediate transfer member 50 to thereby form a composite color image (color transfer image).

Meanwhile, on the paper feeding table 200, one of paper feeding rollers 142 is selectively rotated to feed a sheet (recording paper) from one of the paper feeding cassettes 144 equipped in multiple stages in a paper bank 143. The sheet is separated one by one by a separation roller 145 and sent to a paper feeding path 146. The sheet (recording paper) is conveyed by a conveying roller 147 and is guided to a paper feeding path 148 in the copying device main body 150, and stops by colliding with a registration roller 49. Alternatively, a paper feeding roller 142 is rotated to feed a sheet (recording paper) on a manual feed tray 54. The sheet (recording paper) is separated one by one by a separation roller 52 and is guided to a manual paper feeding path 53, and stops by colliding with the registration roller 49. Notably, the registration roller 49 is generally used while grounded, but it may also be used in a state that a bias is being applied for removing paper dust on the sheet. Next, by rotating the registration roller 49 in accordance with the timing of the composite toner image (color transferred image) formed on the intermediate transfer member 50, the sheet (recording paper) is fed to between the intermediate transfer member 50 and the secondary transfer device 22.

Thereby, the composite toner image (color transferred image) is transferred (secondarily transferred) by the secondary transfer device 22 onto the sheet (recording paper) to thereby form a color image on the sheet (recording paper). Notably, a residual toner remaining on the intermediate transfer member 50 after image transfer is removed by the cleaning device for the intermediate transfer member 17.

The sheet (recording paper) on which the color image has been transferred is conveyed by the secondary transfer device 22, and then conveyed to the fixing device 25. In the fixing device 25, the composite color image (color transferred image) is fixed on the sheet (recording paper) by the action of heat and pressure. Next, the sheet (recording paper) is switched by a switching claw 55, and discharged by a discharge roller 56 and stacked in a paper ejection tray 57. Alternatively, the sheet is switched by the switching claw 55, and is inverted by the inverting device 28 to thereby be guided to a transfer position again. After an image is formed similarly on the rear surface, the recording paper is discharged by the discharge roller 56 stacked in the paper ejection tray 57.

(Process Cartridge)

A process cartridge of the present invention is molded so as to be mounted to various image forming apparatuses in an attachable and detachable manner, including at least an electrostatic latent image bearer configured to bear an electrostatic latent image; and a developing unit configured to form a toner image by developing the electrostatic latent image born on the electrostatic latent image bearer with a developer of the present invention. Note that, the process cartridge of the present invention may further include other units, if necessary.

The developing unit includes a developer accommodating container configured to accommodate the developer of the present invention, and a developer bearing member configured to bear and convey the developer accommodated in the developer accommodating container. Note that, the developing unit further includes a regulating member, and the like, in order to regulate a thickness of the developer born.

Figure 5:
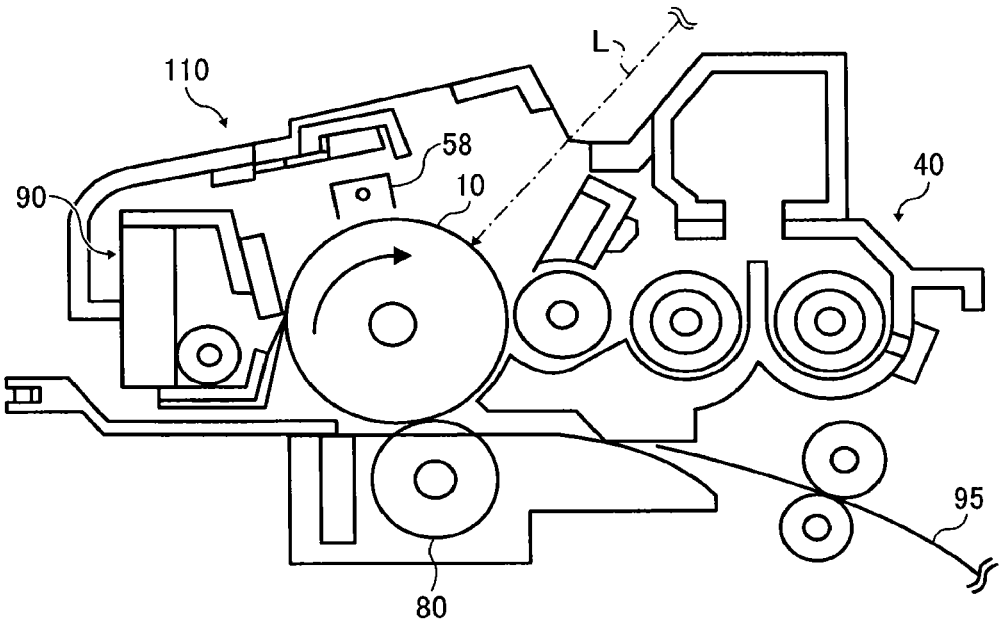
FIG. 5 is a schematic view illustrating an embodiment of the process cartridge of the present invention.

FIG. 5 illustrates one example of a process cartridge of the present invention. A process cartridge 110 includes a photoconductor drum 10, a corona charging device 52, a developing device 40, a transfer roller 80, and a cleaning device 90.

EXAMPLES

Having generally described this invention, further understanding can be obtained by reference to certain specific examples which are provided herein for the purpose of illustration only and are not intended to be limiting. In the descriptions in the following examples, the numbers represent mass ratios in parts, unless otherwise specified.

Production Example 1

<Synthesis of Ketimine>

A reaction container equipped with a stirring rod and a thermometer was charged with isophorone diisocyanate (170 parts) and methyl ethyl ketone (75 parts), followed by reaction at 50° C. for 5 hours, to thereby obtain [ketimine compound 1].

The amine value of the obtained [ketimine compound 1] was found to be 418.

Production Example A-1: Synthesis of Amorphous Polyester Resin A-1

—Synthesis of Prepolymer A-1—

A reaction vessel equipped with a condenser, a stirring device, and a nitrogen-introducing tube was charged with 3-methyl-1,5-pentanediol, isophthalic acid and adipic acid so that a ratio by mole of hydroxyl group to carboxyl group "OH/COOH" was 1.2. A diol component was composed of 100 mol % of 3-methyl-1,5-pentanediol, and a dicarboxylic acid component was composed of 90 mol % of terephthalic acid and 10 mol % of adipic acid. Moreover, titanium tetraisopropoxide (1,000 ppm relative to the resin component) was added thereto such that the amount of trimethylol propane was 1 mol % in total monomers. Thereafter, the resultant mixture was heated to 200° C. for about 4 hours, then was heated to 230° C. for 2 hours, and was allowed to react until no flowing water was formed. Thereafter, the reaction mixture was allowed to further react for 5 hours under a reduced pressure of from 10 to 15 mmHg, to thereby obtain an intermediate polyester A'-1. The intermediate polyester A'-1 had a Tg of −5° C., a Mw 13,000 and a Mw/Mn of 2.2

Next, a reaction vessel equipped with a condenser, a stirring device, and a nitrogen-introducing tube was charged with the intermediate polyester A'-1 solution and lysine triisocyanate (RTI) at a ratio by mole (isocyanate group of RTI/hydroxyl group of the intermediate polyester) of 0.2. The resultant mixture was diluted with ethyl acetate so as to be a 50% ethyl acetate solution, followed by reacting at 100° C. for 5 hrs, to thereby obtain an intermediate polyester A-1. The intermediate polyester A-1 had a Tg of 0° C., a Mw 19,000 and a Mw/Mn of 2.4

Next, a reaction vessel equipped with a condenser, a stirring device, and a nitrogen-introducing tube was charged with the intermediate polyester A-1 solution and isophorone diisocyanate (IPDI) at a ratio by mole (isocyanate group of IPDI/hydroxyl group of the intermediate polyester) of 1.5. The resultant mixture was diluted with ethyl acetate so as to be a 50% ethyl acetate solution, followed by reacting at 100° C. for 5 hrs, to thereby obtain a prepolymer A-1.

—Synthesis of Amorphous Polyester Resin A-1—

The obtained prepolymer A-1 was stirred in a reaction vessel equipped with a heating device, a stirring device, and a nitrogen-introducing tube. The [ketimine compound 1] was added dropwise to the reaction vessel in such an amount that an amount by mole of amine in the [ketimine compound 1] was equal to an amount by mole of isocyanate in the prepolymer a-1. The reaction mixture was stirred at 45° C. for 10 hrs, and then a prepolymer product extended was taken out. The obtained prepolymer product extended was dried at 50° C. under a reduced pressure until an amount of the remaining ethyl acetate was 100 ppm or less, to thereby obtain an amorphous polyester resin A-1.

Production Example A-2: Synthesis of Amorphous Polyester Resin A-2

—Synthesis of Prepolymer A-2—

A reaction vessel equipped with a condenser, a stirring device, and a nitrogen-introducing tube was charged with 3-methyl-1,5-pentanediol, terephthalic acid and adipic acid so that a ratio by mole of hydroxyl group to carboxyl group "OH/COOH" was 1.2. A diol component was composed of 100 mol % of 3-methyl-1,5-pentanediol, and a dicarboxylic acid component was composed of 50 mol % of terephthalic acid and 50 mol % of adipic acid. Moreover, titanium tetraisopropoxide (1,000 ppm relative to the resin component) was added thereto. Thereafter, the resultant mixture was heated to 200° C. for about 4 hrs, then was heated to 230° C. for 2 hrs, and was allowed to react until no flowing water was formed.

Thereafter, the reaction mixture was allowed to further react for 5 hrs under a reduced pressure of 10 to 15 mmHg, to thereby obtain an intermediate polyester A'-2. The intermediate polyester A'-2 had a Tg of −40° C., a Mw 15,000 and a Mw/Mn of 2.0.

Next, a reaction vessel equipped with a condenser, a stirring device, and a nitrogen-introducing tube was charged with the intermediate polyester A'-2 and isophorone diisocyanate (IPDI) at a ratio by mole (isocyanate group of IPDI/hydroxyl group of the intermediate polyester) of 0.2. The resultant mixture was diluted with ethyl acetate so as to be a 50% ethyl acetate solution, followed by reacting at 100° C. for 5 hrs, to thereby obtain an intermediate polyester A-2.

The intermediate polyester A-2 had a Tg of −34° C., a Mw 17,000 and a Mw/Mn of 2.2.

Next, a reaction vessel equipped with a condenser, a stirring device, and a nitrogen-introducing tube was charged with the intermediate polyester A-2 and isophorone diisocyanate (IPDI) at a ratio by mole (isocyanate group of IPDI/hydroxyl group of the intermediate polyester) of 1.5. The resultant mixture was diluted with ethyl acetate so as to be a 50% ethyl acetate solution, followed by reacting at 100° C. for 5 hrs, to thereby obtain a prepolymer A-2.

—Synthesis of Amorphous Polyester Resin A-2—

The obtained prepolymer A-2 was stirred in a reaction vessel equipped with a heating device, a stirring device, and a nitrogen-introducing tube. The [ketimine compound 1] was added dropwise to the reaction vessel in such an amount that an amount by mole of amine in the [ketimine compound 1] was equal to an amount by mole of isocyanate in the prepolymer a-3. The reaction mixture was stirred at 45° C. for 10 hrs, and then a prepolymer product extended was taken out. The obtained prepolymer product extended was dried at 50° C. under a reduced pressure until an amount of the remaining ethyl acetate was 100 ppm or less, to thereby obtain an amorphous polyester resin A-2.

Production Example B-1: Synthesis of Amorphous Polyester Resin B-1

A four-necked flask equipped with a nitrogen-introducing tube, a dehydration tube, a stirring device, and a thermocouple was charged with bisphenol A ethylene oxide 2 mole adduct, bisphenol A propylene oxide 2 mole adduct, terephthalic acid and adipic acid so that a ratio by mole of bisphenol A ethylene oxide 2 mole adduct to bisphenol A propylene oxide 2 mole adduct (bisphenol A ethylene oxide 2 mole adduct/bisphenol A propylene oxide 2 mole adduct) was set to 60/40, a ratio by mole of terephthalic acid to adipic acid (terephthalic acid/adipic acid) was set to 90/73, the amount of trimethylol propane was 1 mol % in total monomers, and a ratio by mole of hydroxyl group to carboxyl group "OH/COOH" was 1.3. Moreover, titanium tetraisopropoxide (500 ppm relative to the resin component) was added thereto and the resultant mixture was allowed to react under normal pressure at 230° C. for 8 hrs and then to further react under a reduced pressure of 10 to 15 mmHg for 4 hrs. Then, trimellitic anhydride was added to the vessel so that an amount thereof was 1 mol % relative to the total resin component, followed by reacting at 180° C. under normal pressure for 3 hrs, to thereby obtain an amorphous polyester resin B-1. The resin had a weight-average molecular weight (Mw) of 5,300 and a Tg of 67° C.

Production Example C-1: Synthesis of Amorphous Polyester Resin C-1

A four-necked flask of 5 L equipped with a nitrogen-introducing tube, a dehydration tube, a stirring device, and a thermocouple was charged with sebacic acid and 1,6-hexanediol so that a ratio by mole of hydroxyl group to carboxyl group "OH/COOH" was 0.9. Moreover, titanium tetraisopropoxide (500 ppm relative to the resin component) was added thereto, and the resultant mixture was allowed to react at 180° C. for 10 hrs, heated to 200° C., allowed to react 3 hrs, and then to further react under a pressure of 8.3 kPa for 2 hrs to thereby obtain a crystalline polyester resin C-1. The resin had a weight-average molecular weight (Mw) of 25,000 and a Tg of 67° C.

[Synthesis of Resin for Dispersing Colorant b1]

A four-necked flask of 5 L equipped with a nitrogen-introducing tube, a dehydration tube, a stirring device, and a thermocouple was charged with 62.5 parts of terephthalic acid, 14.0 parts of ethylene glycol, 23.5 parts of neopentyl glycol and 0.2 parts of dubutyltin oxide, and the resultant mixture was allowed to react at 180° C. for 10 hrs, heated to 200° C., allowed to react 3 hrs, and then to further react under a pressure of 8.3 kPa for 2 hrs to thereby obtain a resin for dispersing colorant b1.

[Synthesis of Resin for Dispersing Colorant b2]

A four-necked flask of 5 L equipped with a nitrogen-introducing tube, a dehydration tube, a stirring device, and a thermocouple was charged with 70 parts of the resin for dispersing colorant b1, 30 parts of the crystalline polyester resin C-1 and 100 parts of toluene, and the mixture was uniformly dissolved at 60° C. Thereafter, 0.2 parts of dibutyltin oxide and 5 parts of diphenylmethane diisocyanate were added to the mixture, and it was allowed to react at 80° C. for 4 hrs.

Toluene was removed from the reactant at 120° C. and 1 kPa to obtain a resin for dispersing colorant b2.

[Synthesis of Resin for Dispersing Colorant b3]

The procedure for preparation of the resin for dispersing colorant b1 was repeated except for changing the formulation as shown in Table 1.

TABLE 1

| | b1 | b3 |
|---|---|---|
| Terephthalic acid | 62.5 | 64.5 |
| Isophthalic acid | 0 | 0 |
| Ethylene glycol | 14 | 0 |
| Neopentyl glycol | 23.5 | 0 |
| Propylene glycol | 0 | 26.6 |
| 1,3-propane diol | 0 | 8.9 |
| Dibutyltinoxide | 0.2 | 0.2 |

T (60)%, T (480)% and T (60)%−T (480)% of the resins for dispersing colorant b1 to b3 are shown in Table 2.

TABLE 2

| | T (60) | T (480) | T (60) − T (480) |
|---|---|---|---|
| b1 | 38 | 1 | 37 |
| b2 | 88 | 86 | 2 |
| b3 | 2 | 1 | 1 |

—Preparation of Masterbatch (MB)—

Preparation of a masterbatch (MB) mainly includes a process of super mixer, a process of mixing roll, a process of rolling, a process of cooling and a process of pulverizing. The process of super mixer includes mixing raw materials such as a pigment, a resin, a wax and water. The process of mixing roll includes kneading. The process of rolling includes thinning the kneaded materials to have the shape of a plate. The plate-shaped materials were cooled, and finally pulverized. All the processes are important to improve dispersibility of a pigment. Particularly, from the process of mixing roll to the process of cooling are important. A normal kneading condition includes performing the process of mixing roll to the process of cooling one time. A medium kneading condition includes performing the process of mixing roll to the process of cooling twice. A strong kneading condition includes performing the process of mixing roll to the process of cooling three times.

A suitable kneading temperature is also effective for improving dispersibility of a pigment, and preferably from 100° C. to 175° C., and more preferably from 125° C. to 150° C.

[Magenta Masterbatch M1]

One hundred (100) parts of water, 40 parts of a magenta pigment (C. I. Pigment Red 269) and 60 parts of the resin for dispersing colorant b1 were mixed and stirred. The resultant mixture was kneaded by a two-roll at 150° C. for 10 min, and further kneaded at 100° C. for 20 min. The resultant kneaded mixture was rolled, cooled and pulverized by a pulverizer from Hosokawa Micron, Ltd. to prepare a magenta masterbatch M1 (normal kneading condition).

[Magenta Masterbatch M2]

After the kneaded mixture of M1 was rolled and cooled, the processes of kneading the mixture by a two-roll at 150° C. for 10 min, further kneading the mixture at 200° C. for 20 min, and rolling and cooling the resultant kneaded mixture were repeated again one time. The rolled and cooled mixture was pulverized by a pulverizer from Hosokawa Micron, Ltd. to prepare a magenta masterbatch M2 (medium kneading condition).

[Magenta Masterbatch M3]

After the kneaded mixture of M2 was rolled and cooled, the processes of kneading the mixture by a two-roll at 150° C. for 10 min, further kneading the mixture at 200° C. for 20 min, and rolling and cooling the resultant kneaded mixture were repeated again one time. The rolled and cooled mixture was pulverized by a pulverizer from Hosokawa Micron, Ltd. to prepare a magenta masterbatch M3 (strong kneading condition).

[Magenta Masterbatch M4]

The procedure for preparation of the magenta masterbatch M3 was repeated except for replacing the resin for dispersing colorant b1 with the resin for dispersing colorant b2 to prepare magenta masterbatch M4.

[Magenta Masterbatch M5]

The procedure for preparation of the magenta masterbatch M1 was repeated except for replacing the resin for dispersing colorant b1 with the amorphous polyester resin B1 to prepare magenta masterbatch M5.

[Cyan Masterbatch C1]

One hundred (100) parts of water, 40 parts of a magenta pigment (C. I. Pigment Blue 15:3 from Dainichiseika Color & Chemicals Mfg. Co., Ltd.) and 60 parts of the resin for dispersing colorant b1 were mixed and stirred. The resultant mixture was kneaded by a two-roll at 150° C. for 10 min, and further kneaded at 100° C. for 20 min. The resultant kneaded mixture was rolled, cooled and pulverized by a pulverizer from Hosokawa Micron, Ltd. to prepare a cyan masterbatch C1 (normal kneading condition).

[Cyan Masterbatch C2]

After the kneaded mixture of C1 was rolled and cooled, the processes of kneading the mixture by a two-roll at 150° C. for 10 min, further kneading the mixture at 100° C. for 20 min, and rolling and cooling the resultant kneaded mixture were repeated again one time. The rolled and cooled mixture was pulverized by a pulverizer from Hosokawa Micron, Ltd. to prepare a cyan magenta masterbatch C2 (medium kneading condition).

[Cyan Masterbatch C3]

After the kneaded mixture of C2 was rolled and cooled, the processes of kneading the mixture by a two-roll at 150° C. for 10 min, further kneading the mixture at 100° C. for 20 min, and rolling and cooling the resultant kneaded mixture were repeated again one time. The rolled and cooled mixture was pulverized by a pulverizer from Hosokawa Micron, Ltd. to prepare a cyan masterbatch C3 (strong kneading condition).

[Cyan Masterbatch C4]

The procedure for preparation of the magenta masterbatch C1 was repeated except for replacing the resin for dispersing colorant b1 with the resin for dispersing colorant b2 to prepare cyan masterbatch C4.

[Cyan Masterbatch C5]

The procedure for preparation of the magenta masterbatch C2 was repeated except for replacing the resin for dispersing colorant b1 with the resin for dispersing colorant b3 to prepare cyan masterbatch C5.

[Cyan Masterbatch C6]

The procedure for preparation of the magenta masterbatch C1 was repeated except for replacing the resin for dispersing colorant b1 with the resin for dispersing colorant b3 to prepare cyan masterbatch C6.

[Yellow Masterbatch Y1]

One hundred (100) parts of water, 40 parts of a yellow pigment (C. I. Pigment Yellow 185 from BASF) and 60 parts of the resin for dispersing colorant b1 were mixed and stirred. The resultant mixture was kneaded by a two-roll at 150° C. for 10 min, and further kneaded at 100° C. for 20 min. The resultant kneaded mixture was rolled, cooled twice and pulverized by a pulverizer from Hosokawa Micron, Ltd. to prepare a yellow masterbatch Y1 (medium kneading condition).

[Yellow Masterbatch Y2]

After the kneaded mixture of Y1 was rolled and cooled twice, the processes of kneading the mixture by a two-roll at 150° C. for 10 min, further kneading the mixture at 100° C. for 20 min, and rolling and cooling the resultant kneaded mixture were repeated again one time. The rolled and cooled mixture was pulverized by a pulverizer from Hosokawa Micron, Ltd. to prepare a yellow masterbatch Y2 (strong kneading condition).

[Yellow Masterbatch Y3]

The procedure for preparation of the magenta masterbatch Y1 was repeated except for replacing the resin for dispersing colorant b1 with the amorphous polyester resin B-1 to prepare yellow masterbatch Y3.

[Yellow Masterbatch Y4]

One hundred (100) parts of water, 40 parts of a yellow pigment (C. I. Pigment Yellow 185 from BASF) and 60 parts of the resin for dispersing colorant b1 were mixed and stirred. The resultant mixture was kneaded by a two-roll at 150° C. for 10 min, and further kneaded at 100° C. for 20 min. The resultant kneaded mixture was rolled, cooled and pulverized by a pulverizer from Hosokawa Micron, Ltd. to prepare a yellow masterbatch Y4 (normal kneading condition).

[Yellow Masterbatch Y5]

The procedure for preparation of the yellow masterbatch Y4 was repeated except for replacing the resin for dispersing colorant b3 with the resin for dispersing colorant b2 to prepare yellow masterbatch Y5.

[Black Masterbatch B1]

Water (100 parts), 40 parts of carbon black (PRINTEX 35, product of Degussa) [DBP oil absorption amount=42 mL/100 mg, pH=9.5], and 60 parts of the resin for dispersing colorant b3 were mixed and stirred. The resultant mixture was kneaded by a two-roll at 150° C. for 10 min, and further kneaded at 100° C. for 20 min. The resultant kneaded mixture was rolled, cooled and pulverized by a pulverizer from Hosokawa Micron, Ltd. to prepare a black masterbatch B1 (normal kneading condition).

[Black Masterbatch B2]

Water (100 parts), 40 parts of carbon black (PRINTEX 35, product of Degussa) [DBP oil absorption amount=42 mL/100 mg, pH=9.5], and 60 parts of the resin for dispersing colorant b3 were mixed and stirred. The resultant mixture was kneaded by a two-roll at 150° C. for 10 min, and further kneaded at 100° C. for 20 min. The resultant kneaded mixture was rolled, cooled three times and pulverized by a pulverizer from Hosokawa Micron, Ltd. to prepare a black masterbatch B2 (normal kneading condition).

[Black Masterbatch B3]

The procedure for preparation of the black masterbatch B1 was repeated except for replacing the resin for dispersing colorant b3 with the amorphous polyester resin B-1 to prepare black masterbatch B3.

<Preparation of WAX Dispersion Liquid>

A vessel to which a stirring bar and a thermometer had been set was charged with 50 parts of paraffin wax (HNP-9, product of Nippon Seiro Co., Ltd., hydrocarbon wax, melting point: 75° C., SP value: 8.8) as release agent 1, and 450 parts of ethyl acetate, followed by heating to 80° C. during stirring. The temperature was maintained at 80° C. for 5 hrs, and then the mixture was cooled to 30° C. in 1 hr. The resultant mixture was dispersed by a bead mill (ULTRA VISCOMILL, product of AIMEX CO., Ltd.) under the following conditions: a liquid feed rate of 1 kg/hr, disc circumferential velocity of 6 m/s, zirconia beads having a diameter of 0.5 mm packed to 80% by volume, and 3 passes, to thereby obtain [WAX dispersion liquid 1].

<Preparation of Crystalline Polyester Resin Dispersion Liquid>

A vessel to which a stirring bar and a thermometer had been set was charged with 50 parts of the crystalline polyester resin C-1, 450 parts of ethyl acetate, followed by heating to 80° C. during stirring. The temperature was maintained at 80° C. for 5 hrs, followed by cooling to 30° C. in 1 hr. The resultant mixture was dispersed by a bead mill (ULTRA VISCOMILL, product of AIMEX CO., Ltd.) under the following conditions: a liquid feed rate of 1 kg/hr, disc circumferential velocity of 6 m/s, zirconia beads having a diameter of 0.5 mm packed to 80% by volume, and 3 passes, to thereby obtain [crystalline polyester resin dispersion liquid C].

<Preparation of Oil Phase>

A vessel was charged with 50 parts of the [WAX dispersion liquid C], 150 parts of the [amorphous polyester resin A-1], 50 parts of the [crystalline polyester resin dispersion liquid 1], 750 parts of the [amorphous polyester resin B-1], 50 parts of the [master batch 1], and 2 parts of the [ketimine compound 1] as a curing agent, followed by mixing using a TK Homomixer (product of PRIMIX Corp.) at 5,000 rpm for 60 min, to thereby obtain [oil phase 1].

The above blended amount is an amount of solid content of each of the materials.

<Synthesis of Organic Fine Particle Emulsion (Particle Dispersion Liquid)>

A reaction vessel equipped with a stirring bar and a thermometer was charged with 683 parts of water, 11 parts of a sodium salt of sulfuric acid ester of methacrylic acid-ethylene oxide adduct (ELEMINOL RS-30, product of Sanyo Chemical Industries, Ltd.), 138 parts of styrene, 138 parts of methacrylic acid, and 1 part of ammonium persulfate, and the resultant mixture was stirred for 15 min at 400 rpm, to thereby obtain a white emulsion. The obtained emulsion was heated to have the system temperature of 75° C., and then was allowed to react for 5 hrs. To the resultant mixture, 30 parts of a 1% ammonium persulfate aqueous solution was added, followed by aging for 5 hrs at 75° C., to thereby obtain an aqueous dispersion liquid of a vinyl resin (a copolymer of styrene/methacrylic acid/sodium salt of sulfuric acid ester of methacrylic acid ethylene oxide adduct), i.e., [particle dispersion liquid 1].

The [particle dispersion liquid 1] was measured by LA-920 (product of HORIBA, Ltd.), and as a result, a volume average particle diameter thereof was found to be 0.14 μm. A part of the [particle dispersion liquid 1] was dried, to thereby isolate a resin content.

<Preparation of Aqueous Phase>

Water (990 parts), 83 parts of the [particle dispersion liquid], 37 parts of a 48.5% aqueous solution of sodium dodecyl diphenyl ether disulfonate (ELEMINOL MON-7, product of Sanyo Chemical Industries Ltd.), and 90 parts of ethyl acetate were mixed and stirred, to thereby obtain an opaque white liquid. The obtained liquid was used as [aqueous phase 1].

<Emulsification•Removal of Solvent>

The [aqueous phase 1] (1,200 parts) was added to a container charged with the [oil phase 1], and the resultant mixture was mixed by a TK Homomixer at 13,000 rpm for 20 min, to thereby obtain [emulsified slurry 1].

A container equipped with a stirrer and a thermometer was charged with the [emulsified slurry 1], followed by removing the solvent therein at 30° C. for 8 hrs. Thereafter, the resultant mixture was aged at 45° C. for 4 hrs, to thereby obtain [dispersion slurry 1].

<Washing•Drying>

After subjecting 100 parts of the [dispersion slurry 1] to filtration under a reduced pressure, the obtained cake was subjected twice to a series of treatments (1) to (4) described below, to thereby produce [filtration cake].

(1): ion-exchanged water (100 parts) was added to the filtration cake, followed by mixing with a TK Homomixer (at 12,000 rpm for 10 min), and then the mixture was filtrated;

(2): one hundred (100) parts of 10% aqueous sodium hydroxide solution was added to the filtration cake obtained in (1), followed by mixing with a TK Homomixer (at 12,000 rpm for 30 min), and then the resultant mixture was filtrated under a reduced pressure;

(3): one hundred (100) parts of 10% by weight hydrochloric acid was added to the filtration cake obtained in (2), followed by mixing with a TK Homomixer (at 12,000 rpm for 10 min) and then the mixture was filtrated; and (4): ion-exchanged water (300 parts) was added to the filtration cake obtained in (3), followed by mixing with a TK Homomixer (at 12,000 rpm for 10 min) and then the mixture was filtrated.

Next, the [filtration cake] was dried with an air-circulating drier at 45° C. for 48 hrs, and then was caused to pass through a sieve with a mesh size of 75 μm, to thereby obtain [toner base particle].

—External Additive Treatment—

One hundred (100) parts of the [toner base particle] were mixed with 0.6 parts of hydrophobic silica having an average particle diameter of 100 nm, 1.0 parts of titanium oxide having an average particle diameter of 20 nm and 0.8 parts of hydrophobic silica fine powder having an average particle diameter of 15 nm by a Henschel mixer to obtain a toner of Example 1.

Examples 2 to 15 and Comparative Examples 1 to 5

Toners of Examples 2 to 15 and Comparative Examples 1 to 5 were obtained according to constitutional ratios shown in Table 3.

Island structures (average particle diameter and the number) and uneven distribution rates of pigment of the toners of Examples 2 to 15 and Comparative Examples 1 to 5 are shown in Table 3 as well.

TABLE 3

| | Amorphous polyester resin A-1 | Amorphous polyester resin A-2 | Amorphous polyester resin B-1 | Crystalline polyester Resin C-1 | Master batch | |
|---|---|---|---|---|---|---|
| | Parts by mass | Parts by mass | Parts by mass | Parts by mass | Name | Parts by mass |
| Example 1 | 150 | 0 | 750 | 50 | M3 | 30 |
| Example 2 | 150 | 0 | 750 | 50 | C3 | 30 |
| Example 3 | 150 | 0 | 750 | 50 | Y2 | 30 |
| Example 4 | 150 | 0 | 750 | 50 | B2 | 30 |
| Example 5 | 150 | 0 | 750 | 50 | M1 | 30 |
| Example 6 | 150 | 0 | 750 | 50 | C1 | 30 |
| Example 7 | 150 | 0 | 750 | 50 | M2 | 30 |
| Example 8 | 150 | 0 | 750 | 50 | C4 | 30 |
| Example 9 | 150 | 0 | 750 | 50 | C2 | 30 |
| Example 10 | 150 | 0 | 750 | 50 | Y1 | 30 |
| Example 11 | 150 | 0 | 750 | 50 | C5 | 30 |
| Example 12 | 150 | 0 | 750 | 50 | Y3 | 30 |
| Example 13 | 0 | 150 | 750 | 50 | M3 | 30 |
| Example 14 | 150 | 0 | 750 | 50 | M4 | 30 |
| Example 15 | 150 | 0 | 750 | 50 | B1 | 30 |
| Comparative Example 1 | 150 | 0 | 750 | 50 | M5 | 30 |
| Comparative Example 2 | 150 | 0 | 750 | 50 | Y4 | 30 |
| Comparative Example 3 | 150 | 0 | 750 | 50 | Y5 | 30 |
| Comparative Example 4 | 150 | 0 | 750 | 50 | C6 | 30 |
| Comparative Example 5 | 150 | 0 | 750 | 50 | B3 | 30 |

| | Resin for dispersing colorant Name | Island structure average particle diameter μm | Number of island structure PCS | Uneven distribution rate of pigment % |
|---|---|---|---|---|
| Example 1 | b1 | 0.5 | 15 | 10 |
| Example 2 | b1 | 0.3 | 18 | 25 |
| Example 3 | b1 | 0.7 | 12 | 9 |
| Example 4 | b1 | 0.4 | 17 | 13 |
| Example 5 | b1 | 0.4 | 13 | 7 |
| Example 6 | b1 | 0.2 | 20 | 48 |
| Example 7 | b1 | 0.5 | 11 | 3 |
| Example 8 | b2 | 0.3 | 18 | 52 |
| Example 9 | b1 | 0.3 | 12 | 25 |
| Example 10 | b1 | 0.7 | 18 | 9 |
| Example 11 | b3 | 0.3 | 8 | 23 |
| Example 12 | B-1 | 0.7 | 22 | 10 |
| Example 13 | b1 | 0.4 | 13 | 9 |
| Example 14 | b2 | 0.5 | 15 | 10 |
| Example 15 | b3 | 0.4 | 17 | 13 |
| Comparative Example 1 | B-1 | 0.1 | 28 | 40 |
| Comparative Example 2 | b3 | 2.5 | 5 | 20 |
| Comparative Example 3 | b2 | 0.9 | 3 | 32 |
| Comparative Example 4 | b3 | 0.2 | 32 | 35 |
| Comparative Example 5 | B-1 | No island structure | | 15 |

<Evaluation>

A developer using each of the toners was prepared by the following method, and evaluated as follows. The results are shown in Table 4.

[Preparation of Developer]

—Preparation of Carrier—

The following materials were mixed and dispersed by a homomixer for 20 min to prepare a coating liquid. The coating liquid was coated by a fluidized-bed coater on 1,000 parts of spherical magnetite having a particle diameter of 50 μm to prepare a carrier.

| | |
|---|---|
| Silicone resin (organo straight silicone) | 100 |
| Toluene | 100 |
| γ-(2-aminoethyl)aminopropyltrimethoxysilane | 5 |
| Carbon black | 10 |

—Preparation of Developer—

5 parts of each of the toners and 95 parts of the carrier were mixed by a ball mill to prepare developers.

<<Heat Resistant Preservability (Penetration)>>

A 50 mL glass container was charged with the toner, and after the container was left in a 50° C. thermostatic chamber for 24 hrs, the temperature was lowered to 24° C. Next, a penetration [mm] of the toner was measured according to JIS K 2235-1991 to evaluate based on the following criteria. The larger the penetration, the better the heat resistant preservability. When less than 5 mm, the toner may have a problem in practical use. The penetration in the present invention is a depth of the penetration.

[Evaluation Criteria]

Excellent: not less than 20 mm and less than 25 mm

Good: not less than 10 mm and less than 20 mm

Fair: not less than 5 mm and less than 10 mm

Poor: less than 5 mm (Image Inspection)

The toner was mixed with a carrier used in imagio MP C4300 from Ricoh Company, Ltd. such that the toner has a concentration of 5% and a yellow unit thereof includes 180 g of the developer.

imagio MP C4300 from Ricoh Company, Ltd. was charged with the developer to produce a rectangular solid image having a size of 2 cm×15 cm on a PPC sheet TYPE 6000<70W>A4 T so as to have a toner adherence amount of 0.40 mg/cm$^2$ and 0.30 mg/cm$^2$. Then, the surface temperature of the fixing roller was 120° C. The image density of each of yellow, cyan, magenta and black toner was measured by X-Rite 938 from X-Rite, Inc. at status A mode and d50.

<<ID (Image Density)>>

When the toner amount was 0.40 mg/cm$^2$,

Excellent: ID was not less than 1.5

Good: ID was not less than 1.4 and less than 1.5

Fair: ID was not less than 1.2 and less than 1.4

Poor: ID was less than 1.2

<<ID (Image Density) Curve>>

Difference of ID between the toner amounts of 0.40 mg/cm$^2$ and 0.30 mg/cm$^2$.

Excellent: ID difference was not less than 0.3

Good: ID difference was not less than 0.2 and less than 0.3

Fair: ID difference was not less than 0.1 and less than 0.2

Poor: ID difference was less than 0.1

<<Low-Temperature Fixability>>

When a residual image of a solid image fixed on a paper medium from an image bearer was fixed on an undesired position (cold offset and hot offset), low-temperature fixability was poor. When no offset was observed, low-temperature fixability was good.

[Evaluation Criteria]

Excellent: higher than 105° C. and not higher than 110° C.

Good: higher than 110° C. and not higher than 115° C.

Fair: higher than 115° C. and not higher than 130° C.

Poor: higher than 130° C.

<<Image Glossiness>>

A fixer of imagio MP C4300 from Ricoh Company, Ltd. was modified, and an image was produced on POD gloss coat having a weight of 128 g/m$^2$ from Oji Paper Co., Ltd.

Specifically, 60° images glossiness produced at fixing temperatures of 140° C. and 150° C., a paper feeding linear speed of 100 mm/sec, a surface pressure of 1.0 kgf/cm$^2$ and a nip width of 7 mm were measured by a gloss meter VG-7000 from Nippon Denshoku Industries Co., Ltd.

[Evaluation Criteria]

Excellent: image glossiness was not less than 30

Good: image glossiness was not less than 20 and less than 30

Fair: image glossiness was not less than 10 and less than 20

Poor: image glossiness was less than 10

<<Image Glossiness Curve>>

A difference of image glossiness at a fixing temperature of 140° C. and that at 150° C. was evaluated as follows.

Excellent: the difference of image glossiness was not less than 10

Good: the difference of image glossiness was not less than 5 and less than 10

Fair: the difference of image glossiness was not less than 2 and less than 5

Poor: the difference of image glossiness was less than 2

TABLE 4

| | Heat resistant preservability | Low-temperature fixability | Image glossiness 140° | Image glossiness Curve | ID 0.30 mg/cm$^2$ | ID Curve |
|---|---|---|---|---|---|---|
| Example 1 | Excellent | Excellent | Excellent | Excellent | Excellent | Excellent |
| Example 2 | Excellent | Excellent | Excellent | Excellent | Excellent | Excellent |
| Example 3 | Excellent | Excellent | Excellent | Excellent | Excellent | Excellent |
| Example 4 | Excellent | Excellent | Excellent | Excellent | Excellent | Excellent |
| Example 5 | Excellent | Excellent | Excellent | Excellent | Excellent | Excellent |
| Example 6 | Excellent | Excellent | Excellent | Excellent | Excellent | Excellent |
| Example 7 | Excellent | Excellent | Excellent | Good | Excellent | Good |
| Example 8 | Excellent | Good | Excellent | Excellent | Excellent | Excellent |
| Example 9 | Excellent | Excellent | Excellent | Excellent | Excellent | Excellent |
| Example 10 | Excellent | Excellent | Excellent | Excellent | Excellent | Excellent |
| Example 11 | Good | Good | Excellent | Excellent | Excellent | Excellent |
| Example 12 | Good | Good | Excellent | Excellent | Excellent | Excellent |
| Example 13 | Excellent | Excellent | Good | Good | Good | Good |

TABLE 4-continued

| | Heat resistant preservability | Low-temperature fixability | Image glossiness 140° | Image glossiness Curve | ID 0.30 mg/cm$^2$ | ID Curve |
|---|---|---|---|---|---|---|
| Example 14 | Good | Good | Excellent | Excellent | Excellent | Excellent |
| Example 15 | Good | Good | Excellent | Excellent | Excellent | Excellent |
| Comparative Example 1 | Fair | Poor | Fair | Fair | Fair | Fair |
| Comparative Example 2 | Fair | Fair | Poor | Poor | Fair | Fair |
| Comparative Example 3 | Poor | Fair | Fair | Fair | Fair | Fair |
| Comparative Example 4 | Fair | Poor | Fair | Fair | Fair | Fair |
| Comparative Example 5 | Poor | Poor | Fair | Fair | Fair | Fair |

Having now fully described the invention, it will be apparent to one of ordinary skill in the art that many changes and modifications can be made thereto without departing from the spirit and scope of the invention as set forth therein.

What is claimed is:

1. A toner, comprising:

a base particle, comprising:

a polyester resin; and a colorant, wherein a sea-island structure is observed by a transmission electron microscope (TEM) in a cross-sectional image of the toner, and wherein the island structure comprises the colorant and has an average diameter of from 0.2 μm to 1.0 μm, and the number of the island structure is from 5 to 30.

2. The toner of claim 1, wherein the colorant is present within a depth of 1,000 nm in the toner in an amount of from 5% to 50% based on total amount of the colorant.

3. The toner of claim 1, wherein the number of the island structure is from 10 to 20.

4. The toner of claim 1, further comprising trivalent aliphatic isocyanate as a tetrahydrofuran-insoluble matter.

5. The toner of claim 1, further comprising a resin for dispersing colorant, wherein when the resin is dissolved in ethylacetate such that a solid content is 20% by mass, the solution satisfies the following relation:

$$T(60)\%-T(480)\%\geq 30\%;\text{ and}$$

$$T(480)\%\geq 50\%,$$

wherein T (60)% and T (480)% are transmittances for light of 500 nm with an optical path length of 1 cm, respectively obtained at time when 60 minutes has passed and at time when 480 min has passed, after the resin is dissolved.

6. The toner of claim 5, wherein T (60)% is not less than 30%.

7. The toner of claim 1, wherein the polyester resin has a structure having any one of the following formulae (1) to (3):

$$R1\text{-}(NHCONH—R2)n\text{-} \quad (4)$$

$$R1\text{-}(NHCOO—R2)n\text{-} \quad (5)$$

$$R1\text{-}(OCONH—R2)n\text{-} \quad (6)$$

wherein n represent an integer not less than 3; R1 represents an aromatic or an aliphatic organic group; and R2 represents a group derived from a polyester resin formed at least one of polycarboxylic acid and polyol or an isocyanate-modified polyester resin.

8. The toner of claim 1, wherein the toner is obtained by a method comprising:

dissolving or dispersing a binder resin in an organic solvent to prepare a solution or a dispersion;

dispersing or emulsifying the solution or the dispersion in an aqueous medium to prepare a dispersion liquid or an emulsified liquid; and removing the organic solvent from the dispersion liquid or then emulsified liquid.

9. A developer comprising the toner according to claim 1.

10. A developer containing unit containing the developer according to claim 9.

* * * * *